US008486597B2

(12) United States Patent
Yamamoto et al.

(10) Patent No.: US 8,486,597 B2
(45) Date of Patent: Jul. 16, 2013

(54) TONER, AND METHOD FOR PRODUCING THE SAME

(75) Inventors: Atsushi Yamamoto, Shizuoka (JP); Takuya Kadota, Hyogo (JP); Masayuki Hagi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 213 days.

(21) Appl. No.: 13/080,053

(22) Filed: Apr. 5, 2011

(65) Prior Publication Data

US 2011/0244383 A1 Oct. 6, 2011

(30) Foreign Application Priority Data

Apr. 6, 2010 (JP) ..... 2010-087615

(51) Int. Cl.
*G03G 9/087* (2006.01)

(52) U.S. Cl.
USPC ..... 430/109.1; 430/109.3; 430/109.4; 430/110.1; 430/110.2

(58) Field of Classification Search
USPC ..... 430/109.1, 109.3, 109.4, 110.1, 110.2
See application file for complete search history.

(56) References Cited

U.S. PATENT DOCUMENTS

| | | | | |
|---|---|---|---|---|
| 7,550,242 | B2 | 6/2009 | Nozaki et al. | |
| 7,556,904 | B2 | 7/2009 | Kadota et al. | |
| 7,556,906 | B2 | 7/2009 | Katoh et al. | |
| 7,587,159 | B2 | 9/2009 | Fuwa et al. | |
| 7,632,619 | B2 | 12/2009 | Mikuriya et al. | |
| 7,635,549 | B2 | 12/2009 | Nakamura et al. | |
| 7,678,522 | B2 | 3/2010 | Nakamura et al. | |
| 7,695,885 | B2 | 4/2010 | Yasunaga et al. | |
| 7,709,171 | B2 | 5/2010 | Yamamoto et al. | |
| 7,720,428 | B2 | 5/2010 | Hagi et al. | |
| 7,727,694 | B2 | 6/2010 | Murakami et al. | |
| 7,749,671 | B2 | 7/2010 | Yamamoto et al. | |
| 7,785,760 | B2 | 8/2010 | Yamamoto et al. | |
| 7,811,735 | B2 | 10/2010 | Nakamura et al. | |
| 7,817,946 | B2 | 10/2010 | Murakami et al. | |
| 7,820,348 | B2 | 10/2010 | Hagi et al. | |
| 7,829,254 | B2 | 11/2010 | Kurose et al. | |
| 7,833,686 | B2 | 11/2010 | Kadota et al. | |
| 7,838,193 | B2 | 11/2010 | Hagi et al. | |
| 7,867,680 | B2 | 1/2011 | Mikuriya et al. | |
| 7,867,682 | B2 | 1/2011 | Nozaki et al. | |
| 7,867,685 | B2 | 1/2011 | Murakami et al. | |
| 7,873,300 | B2 | 1/2011 | Fuwa et al. | |
| 7,903,998 | B2 | 3/2011 | Matsumoto et al. | |
| 2006/0057488 | A1* | 3/2006 | Inoue et al. | 430/109.4 |
| 2007/0026335 | A1 | 2/2007 | Yamamoto et al. | |
| 2007/0207399 | A1 | 9/2007 | Kadota et al. | |

(Continued)

FOREIGN PATENT DOCUMENTS

| | | |
|---|---|---|
| JP | 3678060 | 5/2005 |
| JP | 2007-57816 | 3/2007 |

(Continued)

*Primary Examiner* — Hoa V Le
(74) *Attorney, Agent, or Firm* — Oblon, Spivak, McClelland, Maier & Neustadt, L.L.P.

(57) ABSTRACT

A toner including an amorphous resin (R), a crystalline material (A) which is compatible with the amorphous resin (R) and has a melting point of 80° C. or lower, a resin (I) which is different from the amorphous resin (R), and a colorant, wherein the crystalline material (A) is capsulated by the resin (I) and the capsulated crystalline material (A) is present in the amorphous resin (R).

19 Claims, 2 Drawing Sheets

U.S. PATENT DOCUMENTS

| | | | |
|---|---|---|---|
| 2007/0212630 | A1 | 9/2007 | Yasunaga et al. |
| 2007/0217842 | A1 | 9/2007 | Kato et al. |
| 2007/0218384 | A1 | 9/2007 | Matsumoto et al. |
| 2007/0218390 | A1 | 9/2007 | Nozaki et al. |
| 2007/0238042 | A1 | 10/2007 | Yasunaga et al. |
| 2008/0069608 | A1 | 3/2008 | Katoh et al. |
| 2008/0069617 | A1 | 3/2008 | Matsumoto et al. |
| 2008/0070149 | A1 | 3/2008 | Kato et al. |
| 2008/0076054 | A1 | 3/2008 | Nozaki et al. |
| 2008/0096119 | A1 | 4/2008 | Yamamoto et al. |
| 2008/0101823 | A1 | 5/2008 | Katoh et al. |
| 2008/0131797 | A1 | 6/2008 | Ishikawa et al. |
| 2008/0153018 | A1 | 6/2008 | Mikuriya et al. |
| 2008/0159777 | A1 | 7/2008 | Fuwa et al. |
| 2008/0175630 | A1 | 7/2008 | Yasunaga et al. |
| 2008/0176159 | A1 | 7/2008 | Matsumoto et al. |
| 2008/0220357 | A1 | 9/2008 | Nozaki et al. |
| 2008/0226356 | A1 | 9/2008 | Yasunaga et al. |
| 2008/0227001 | A1 | 9/2008 | Kadota et al. |
| 2008/0227009 | A1 | 9/2008 | Fuwa et al. |
| 2008/0227013 | A1 | 9/2008 | Kadota et al. |
| 2008/0227016 | A1 | 9/2008 | Nozaki et al. |
| 2008/0233497 | A1 | 9/2008 | Yamamoto et al. |
| 2008/0233506 | A1 | 9/2008 | Hagi et al. |
| 2008/0233510 | A1 | 9/2008 | Nozaki et al. |
| 2008/0233511 | A1 | 9/2008 | Ishikawa et al. |
| 2008/0279591 | A1 | 11/2008 | Yasunaga et al. |
| 2008/0304875 | A1 | 12/2008 | Katoh et al. |
| 2009/0017391 | A1 | 1/2009 | Yamamoto et al. |
| 2009/0052952 | A1 | 2/2009 | Katoh et al. |
| 2009/0117481 | A1 | 5/2009 | Yasunaga et al. |
| 2009/0220879 | A1 | 9/2009 | Matsumoto et al. |
| 2009/0232542 | A1 | 9/2009 | Yamamoto et al. |
| 2009/0233199 | A1 | 9/2009 | Nozaki et al. |
| 2009/0297975 | A1 | 12/2009 | Ishikawa et al. |
| 2009/0297976 | A1 | 12/2009 | Yamamoto et al. |
| 2010/0009282 | A1 | 1/2010 | Katoh et al. |
| 2010/0055603 | A1 | 3/2010 | Nozaki et al. |
| 2010/0068646 | A1 | 3/2010 | Yamamoto |
| 2010/0227265 | A1 | 9/2010 | Matsumoto et al. |
| 2010/0239974 | A1 | 9/2010 | Nozaki et al. |
| 2010/0272481 | A1 | 10/2010 | Yamamoto et al. |
| 2010/0296848 | A1 | 11/2010 | Yamamoto et al. |
| 2011/0045401 | A1 | 2/2011 | Murakami et al. |
| 2011/0053063 | A1 | 3/2011 | Kadota et al. |
| 2011/0053071 | A1 | 3/2011 | Miki et al. |
| 2011/0053077 | A1 | 3/2011 | Mikuriya et al. |

FOREIGN PATENT DOCUMENTS

| | | |
|---|---|---|
| JP | 2007-233169 | 9/2007 |
| JP | 2009-53695 | 3/2009 |
| JP | 4275391 | 3/2009 |

* cited by examiner

TONER, AND METHOD FOR PRODUCING THE SAME

BACKGROUND OF THE INVENTION

1. Field of the Invention

The present invention relates to a toner capable of achieving energy saving and high quality performance in image forming techniques using an electrophotographic process, such as copiers, laser printers, and facsimiles, and also relates to a method for producing the toner.

2. Description of the Related Art

In image formation through an electrophotographic process, generally, an image is formed using a toner on a print medium such as paper, and then the print medium is heated while being pressurized by a fixing member such as a fixing roller, thereby a final printed matter is obtained. Meanwhile, in environmental problems needing technological solutions, in recent years, apparatus and devices are required to reduce energy consumption. However, in electrophotographic processes, a large amount of energy is consumed in heating in the fixing process, and thus there is a demand to decrease the temperature necessary for the fixing.

As one of measures to decrease the fixing temperature, it is known to reduce the molecular weight and the glass transition temperature of a binder resin constituting a toner so as to melt the binder resin at low temperature. However, when the heating temperature exceeds the glass transition temperature of a resin, the viscosity of the resin gradually decreases as the temperature increases, and thus in order to decrease the temperature necessary for fixing an image on paper or the like, there is a need to design a resin used so as to have a lower molecular weight to some extent and have a low glass transition temperature. When the resin is designed to an extreme, the resulting toner itself causes blocking during storage, splits, deformation and adhesion to various members in developing and/or transfer processes, and as a result, the quality of print images is significantly impaired. For this reason, there is a limitation on this measure. To solve this problem, there is proposed a method in which a crystalline material is added to a toner to be compatible with a binder resin in a fixing process and to reduce the melt-viscosity of the toner, and thereby an image is fixed at a low temperature (see Japanese Patent Application Laid-Open (JP-A) No. 2007-233169).

This proposal disclosed, for the purpose of proposing a toner which is usable in a low-temperature fixing system, has excellent offset resistance, and is capable of forming a high-quality image excellent in image sharpness for a long period of time, without smearing a fixing device and the formed image, a developer using the toner, a toner container, a process cartridge, an image forming apparatus and an image forming method, to make a fixing auxiliary compatible with a polyester resin having a melting point of 50° C. or higher but lower than 150° C. present in the toner in a crystalline phase domain. However, in the course of the production processes, part of the crystalline material is compatible with the binder resin, and thus this technique has a problem that the storage stability of the toner degrades, and the toner is deformed in developing and transferring processes and easily adheres to various members.

Further, Japanese Patent (JP-B) No. 3678060 disclosed a toner containing a crystalline material and a styrene acrylic resin. In the toner described in JP-B No. 3678060, the styrene acrylic resin, which is an amorphous polymer, and the crystalline polyester greatly differ in skeleton and is hardly compatible with each other, and thus each of these materials can be present in an independent state. However, the toner has a problem in that the probability of low temperature fixing is low because of poor compatibility of these materials.

Furthermore, Japanese Patent (JP-B) No. 4275391 describes a technique of using a crystalline polyester and an amorphous polyester, as a binder resin, in a compatible state. In this case, however, the glass transition temperature and toughness of the binder resin as a whole degrade, and thus the toner has a problem with its poor storage stability.

In conventional toners containing crystalline materials as described above, the crystalline material which is added to decrease the melt viscosity of the resulting toner is compatible with a binder resin, and part of the crystalline material is soluble in the binder resin in production processes, resulting in a decrease in the glass transition temperature of the entire system of the toner. Accordingly, such conventional toners have problems in that due to the decrease in the glass transition temperature, the resulting toner undergoes degradation of storage stability, deformation in developing and transferring processes, and adhesion to various members, with ease.

BRIEF SUMMARY OF THE INVENTION

An object of the present invention is to provide a toner which is excellent in heat resistant storage stability and low-temperature fixability irrespective of the system speed even in a low-speed machine or a high-speed machine, excellent in resistance to stress such as developing stress, and which contains a material having a low melting point.

The present inventors carried out extensive studies and examinations in an attempt to solve the above-mentioned problems and have found that it is effective to incorporate, into a toner, a material compatible with a binder resin in a capsulated state. This finding leads to the accomplishment of the present invention.

The present invention has been accomplished on the basis of the finding of the present inventors, and means for solving the above-mentioned problems are as follows:

<1> A toner including:

an amorphous resin (R), a crystalline material (A) which is compatible with the amorphous resin (R) and has a melting point of 80° C. or lower, a resin (I) which is different from the amorphous resin (R), and a colorant, wherein the crystalline material (A) is capsulated by the resin (I) and the capsulated crystalline material (A) is present in the amorphous resin (R).

<2> The toner according to <1>, wherein the amorphous resin (R) is an amorphous polyester resin.

<3> The toner according to one of <1> and <2>, wherein the crystalline material (A) has a melting point lower than 60° C.

<4> The toner according to one of <1> and <2>, wherein the crystalline material (A) has a melting point lower than 50° C.

<5> The toner according to any one of <1> to <4>, wherein the resin (I) is a resin which is incompatible with the crystalline resin (R).

<6> The toner according to any one of <1> to <5>, wherein the crystalline material (A) is a crystalline polyester.

<7> The toner according to any one of <1> to <6>, wherein the crystalline material (A) is a straight-chain hydrocarbon carboxylic acid having 8 to 20 carbon atoms.

<8> The toner according to any one of <1> to <6>, wherein the crystalline material (A) is one of a straight-chain hydrocarbon ester containing an alkyl chain having carbon atoms of 12 or more and a straight-chain hydrocarbon amide containing an alkyl chain having carbon atoms of 12 or more.

<9> The toner according to any one of <1> to <6>, wherein the crystalline material (A) is a straight-chain hydrocarbon ester having total carbon atoms of 8 to 20 per divalent linking group containing ester.

<10> The toner according to any one of <1> to <9>, wherein the amorphous resin (R) has a glass transition temperature of 50° C. or higher.

<11> The toner according to any one of <1> to <10>, wherein the amorphous resin (R) has a glass transition temperature of 65° C. or higher.

<12> A toner production method including:

forming a capsule by capsulating a crystalline material (A) by a resin (I), where the capsule contains at least the crystalline material (A) and the resin (I), and dispersing the capsule in an amorphous resin (R), wherein the crystalline material (A) is compatible with the amorphous resin (R) and has a melting point of 80° C. or lower.

<13> The toner production method according to <12>, further including:

mixing a first dispersion liquid in which the capsule is dispersed in an aqueous medium, a second dispersion liquid in which the amorphous resin (R) is dispersed in an aqueous medium, and a third dispersion liquid containing colorant particles, adding an aggregation agent to the dispersion liquid so that aggregated particles are formed by the capsule, the amorphous resin (R) and the colorant particles, and allowing the aggregated particles to coalesce by increasing the temperature thereof.

<14> The toner production method according to <12>, further including:

dissolving or dispersing, in an organic solvent, at least the capsule, the amorphous resin (R), and the colorant to prepare an oil phase, preparing an aqueous phase containing at least a surfactant in the aqueous medium, dispersing the oil phase in the aqueous phase to prepare a dispersion liquid in which particles formed of the oil phase are dispersed, removing the organic solvent from the dispersion liquid, washing the particles, and drying the particles to removed water therefrom.

<15> The toner production method according to any one of <12> to <14>, wherein the amorphous resin (R) is an amorphous polyester resin.

<16> The toner production method according to any one of <12> to <15>, wherein the crystalline material (A) has a melting point lower than 60° C.

<17> The toner production method according to any one of <12> to <16>, wherein the crystalline material (A) has a melting point lower than 50° C.

<18> The toner production method according to any one of <12> to <17>, wherein the resin (I) is a resin which is incompatible with the crystalline resin (R).

<19> The toner production method according to any one of <12> to <18>, wherein the crystalline material (A) is a crystalline polyester.

<20> The toner production method according to any one of <12> to <19>, wherein the crystalline material (A) is a straight-chain hydrocarbon carboxylic acid having 8 to 20 carbon atoms.

<21> The toner production method according to any one of <12> to <19>, wherein the crystalline material (A) is one of a straight-chain hydrocarbon ester containing an alkyl chain having carbon atoms of 12 or more and a straight-chain hydrocarbon amide containing an alkyl chain having carbon atoms of 12 or more.

<22> The toner production method according to any one of <12> to <19>, wherein the crystalline material (A) is a straight-chain hydrocarbon ester having total carbon atoms of 8 to 20 per divalent linking group containing ester.

<23> The toner production method according to any one of <12> to <22>, wherein the amorphous resin (R) has a glass transition temperature of 50° C. or higher.

<24> The toner production method according to any one of <12> to <23>, wherein the amorphous resin (R) has a glass transition temperature of 65° C. or higher.

<25> A process cartridge including:

a photoconductor, and at least a device configured to develop a latent image on the photoconductor with a developer, as an integral unit, wherein the process cartridge is detachably mounted on an image forming apparatus, wherein the developer includes the toner according to any one of <1> to <11>.

The present invention can solve the above-mentioned conventional problems, achieve the above-mentioned object, and provide a toner which is excellent in heat resistant storage stability and low-temperature fixability irrespective of the system speed even in a low-speed machine or a high-speed machine, excellent in resistance to stress such as developing stress, and which contains a material having a low melting point.

DETAILED DESCRIPTION OF THE INVENTION (Toner)

Hereinafter, embodiments of the present invention will be described.

A toner according to the present invention contains at least an amorphous resin (R), a crystalline material (A) having a melting point of 80° C. or lower and compatible with the amorphous resin (R), a resin (I) which is different from the amorphous resin (R), and a colorant, and when necessary, contains other components.

The crystalline material (A) is present in the amorphous resin (R), in a capsulated state owing to the resin (I).

The present invention is characterized in that, in a latent electrostatic image developing toner, the crystalline material (A), which is a crystalline material having a low melting point, is capsulated, so that the crystalline material (A) is isolated from the amorphous resin (R), which is a binder resin.

By capsulation of a crystalline material to be isolated from a binder resin, it is possible to prevent the crystalline material from being mutually soluble with the binder resin, to maintain the storage stability of the resulting toner and to prevent the resulting toner from adversely affected by stress caused through electrophotographic processes. Further, by heating and pressurizing the toner during fixing, the crystalline material is exited from the capsule to be mutually dissolved with the binder resin, and as a result, the viscosity of the binder resin which is mutually dissolved with the crystalline material is rapidly decreased, and whereby the fixing temperature can be decreased.

The characteristics or the present invention described above will be described in detail with reference to the appended drawings.

Figure 1A:
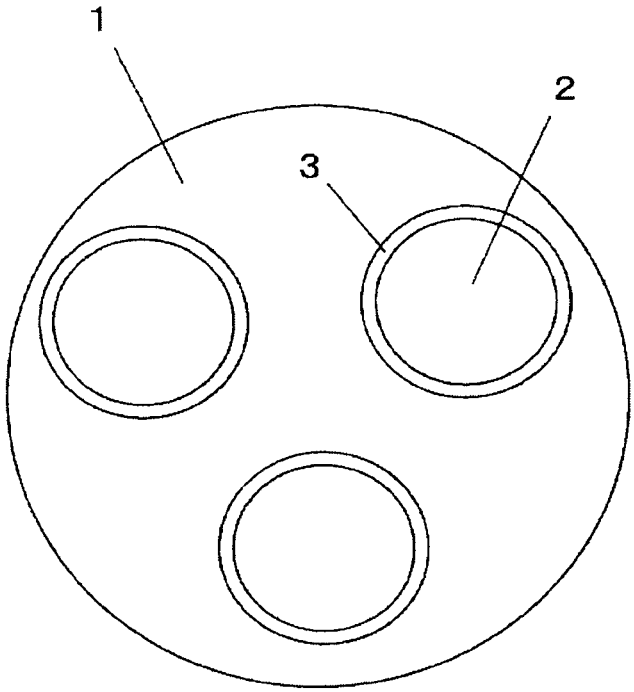
FIG. 1A is a diagram schematically illustrating the structure of a toner according to the present invention.

A toner according to the present invention contains, as illustrated in FIG. 1A, in a particle which includes an amorphous resin (R)1, particles containing crystalline material (A)2 which is compatible with the amorphous resin (R)1 and has a melting point of 80° C. or lower. The crystalline material (A)2 is capsulated by a resin (I)3 which is different from the amorphous resin (R)1. With this, it is possible to prevent the crystalline material (A)2 from being mutually dissolved with the amorphous resin (R)1 in normal circumstances. As the amorphous resin (R)1, for example, an amorphous polyester resin can be used. As the crystalline material (A)2, for example, a crystalline polyester resin can be used. As the resin (I)3, a vinyl resin can be used, for example.

Figure 1B:
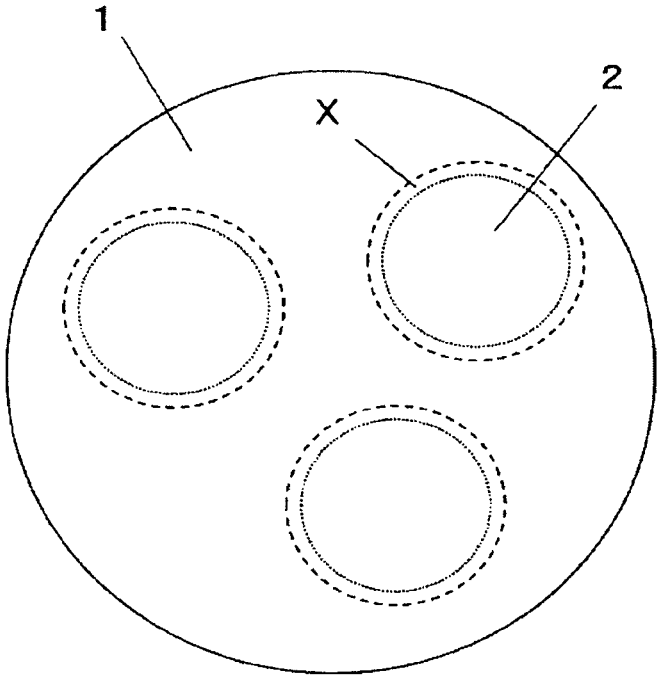
FIG. 1B is a diagram schematically illustrating the structure of a conventional toner.

Meanwhile, a conventional toner which includes a fixing auxiliary inside thereof contains, as illustrated in FIG. 1B, in a particle which includes the amorphous resin (R)1, the particles containing crystalline material (A)2 which is compatible with the amorphous resin (R)1 and has a melting point of 80° C. or lower so that the crystalline material (A)2 is contacted with the amorphous resin (R)1. For this reason, part of the particles containing crystalline material (A)2 are mutually dissolved with the amorphous resin (R)1 surrounding crystalline material (A)2 (a portion indicated by X in FIG. 1B), and as a result, the glass transition temperature of the entire system of the toner is decreased. Therefore, the conventional toner has a problem in that it is not excellent in storage stability.

<Crystalline Material (A)>

The crystalline material (A) is not particularly limited, as long as it is a crystalline material compatible with the amorphous resin (R) and having a melting point of 80° C. or lower, and may be suitably selected. For example, a crystalline compound and a crystalline resin are exemplified. Since the crystalline material (A) is a material which is mutually dissolved with the amorphous resin (R), which is a main component of toner, i.e., a binder resin during fixing to momentarily decrease the melt viscosity of the entire system of the toner, to thereby make the toner fixed at a low temperature, it is preferably compatible with the amorphous resin (R) within a temperature range in which the binder resin is dissolved.

To this end, as the crystalline material (A), a crystalline material having a certain degree of polarity is used. In order for the crystalline material (A) to possess the polarity, it is necessary to have a functional group or binding site each having a polarity. Examples of the a functional group having a polarity include acid groups such as a carboxyl group, a sulfonyl group, and a phosphonyl group; and functional groups such as an amino group. Examples of the binding site having a polarity include an ester bond, ether bond, thio-ester bond, thio-ether bond, sulfone bond, amide bond, imide bond, urea bond, urethane bond, isocyanurate bond, hydroxyl group, and mercapto group.

<<Crystalline Compound>>

Preferred examples of the crystalline compound are a straight-chain hydrocarbon carboxylic acid having carbon atoms of 8 to 20, an acid amide of the carboxylic acid (carboxylic acid amide), an ester compound containing an alkyl chain having carbon atoms of 12 or more, an amide compound containing an alkyl chain having carbon atoms of 12 or more, a straight-chain hydrocarbon ester having total carbon atoms of 8 to 20 per divalent linking group containing ester, from the viewpoints that these substances can be easily made present inside a toner with stability, less adversely affect the environmental stability of toner and are easily compatible with a binder resin when melted therewith.

Examples of the straight-chain hydrocarbon carboxylic acid having carbon atoms of 8 to 20 include lauric acid (carbon atoms: 12), myristic acid (carbon atoms: 14), palmitic acid (carbon atoms: 16), and stearic acid (carbon atoms: 18).

Examples of the amide compound containing an alkyl chain having carbon atoms of 12 or more include N-[2-(diethylamino)ethyl] stearamide (carbon atoms: 24).

Examples of the straight-chain hydrocarbon ester having total carbon atoms of 8 to 20 per divalent linking group containing ester include a compound having one divalent linking group described above (e.g., methyl stearate (carbon atoms: 19), ethyl stearate (carbon atoms: 20), and ethyl palmitate (carbon atoms: 18)); and a compound having two divalent linking groups described above (e.g., ethylene glycol distearate (carbon atoms: 38).

These crystalline compounds encompass those having a plurality of polar functional groups or polar binding sites. The crystalline compounds, which are low molecular weight crystalline substances, are characterized by high molecular mobility of molecules when fused, and thus they are momentarily compatible with a binder resin and enables quickly decreasing the melt viscosity of the entire system of toner.

From the viewpoint of achieving low temperature fixability of toner, the melting point of the crystalline compound to be mutually dissolved with the amorphous resin (R) is not particularly limited as long as it is 80° C. or lower, and may be suitably selected in accordance with the intended use. It is, however, preferably a low melting point of lower than 60° C., and more preferably lower than 50° C. For the same reason, amorphous resin (R) also preferably has a low glass transition temperature. The glass transition temperature of the amorphous resin (R) is preferably 65° C. or higher, and more preferably 50° C. or higher.

<<Crystalline Resin>>

From other viewpoints, as the crystalline resin for use as the crystalline material (A), a crystalline resin like a crystalline polyester resin described below is preferably used. When an amorphous polyester resin is used as a binder resin, the crystalline resin has a similar structure to that of the binder resin, and thus the crystalline resin is easily compatible with the binder resin when the binder resin is fused. Also, the crystalline resin has high mechanical strength because it is a polymer before application of heat, and thus it has excellence in storage stability.

—Crystalline Polyester Resin—

The crystalline polyester resin preferably contains a polyhydric alcohol unit and a carboxylic acid unit and contains a structure represented by —OCOC—R—COO—$(CH_2)_n$— (where R represents a straight-chain unsaturated aliphatic group having 2 to 20 carbon atoms, and n is an integer of 2 to 20) in an amount of at least 60 mol % of overall ester bonds in the resin. Note that in the formula, R preferably represents a residue group of a straight-chain unsaturated aliphatic divalent carboxylic acid with 2 to 20 carbon atoms, and is more preferably a straight-chain unsaturated aliphatic group having 2 to 4 carbon atoms; and n is an integer of 2 to 6.

Examples of the straight-chain unsaturated aliphatic group include straight-chain unsaturated aliphatic groups derived from straight-chain unsaturated divalent carboxylic acids, such as maleic acid, fumaric acid, 1,3-n-propane dicarboxylic acid, 1,4-n-butene dicarboxylic acid.

$(CH_2)n$ described above represents a residue group of a straight-chain aliphatic dihydric alcohol. In this case, as the residue group of the straight-chain aliphatic dihydric alcohol, there may be exemplified those derived from straight-chain aliphatic dihydric alcohols such as ethylene glycol, 1,3-propylene glycol, 1,4-butanediol, and 1,6-hexanediol. As the carboxylic acid unit, a straight-chain unsaturated aliphatic dicarboxylic acid unit is used in the crystalline polyester resin, the crystalline polyester resin exhibits an effect of more easily forming a crystal structure as compared with a crystalline polyester resin in which an aromatic dicarboxylic acid unit is used.

The crystalline polyester resin can be produced by a common method through a polycondensation reaction of (1) a polyvalent carboxylic acid unit including a straight-chain unsaturated aliphatic divalent carboxylic acid or a reactive derivative thereof (e.g., acid anhydride, lower alkyl ester acid halide having 1 to 4 carbon atoms), and (2) a polyhydric alcohol unit including a straight-chain aliphatic diol. In this case, the polyvalent carboxylic acid unit may contain a slight amount of another polyvalent carboxylic acid unit. The another polyvalent carboxylic unit in this case encompasses (1) unsaturated aliphatic divalent carboxylic acid units having a branched chain, (2) saturated aliphatic polyvalent carboxylic acid units such as a saturated aliphatic divalent carboxylic acid and a saturated aliphatic trivalent carboxylic acid, and (3) aromatic polyvalent carboxylic acid units such as an aromatic divalent carboxylic acid and an aromatic trivalent carboxylic acid. The amount of the another polyvalent carboxylic acid units is preferably 30 mol % or less, and more preferably 10 mol % or less to the total amount of the polyvalent carboxylic acid units. The polyvalent carboxylic acid units are appropriately added within a range where the resulting polyester may have crystallinity.

Examples of the polyvalent carboxylic acid unit that can be added as required include divalent carboxylic units (e.g., malonic acid, succinic acid, glutaric acid, adipic acid, suberic acid, sebacic acid, citraconic acid, phthalic acid, and isophthalic acid); and trivalent or higher polyvalent carboxylic acid units (e.g., trimetric anhydride, 1,2,4-benzene tricarboxylic acid, 1,2,5-benzene tricarboxylic acid, 1,2,4-cyclohexane tricarboxylic acid, 1,2,4-naphthalene tricarboxylic acid, 1,2,5-hexane tricarboxylic acid, 1,3-dicarboxyl-2-methylene carboxypropane, and 1,2,7,8-octane tetracarboxylic acid.

The polyhydric alcohol unit may contain, when necessary, a slight amount of an aliphatic-based branched chain dihydric alcohol unit, an aliphatic-based ring-shaped dihydric alcohol unit, and a trihydric or higher polyhydric alcohol unit. The amount of the polyhydric alcohol unit is preferably 30 mol % or less, and more preferably 10 mol % or less to the total amount of alcohol units. The polyhydric alcohol was appropriately added within a range where the resulting polyester may have crystallinity.

Examples of the polyhydric alcohol unit to be added as required include 1,4-bis(hydroxymethyl)cyclohexane unit, polyethylene glycol unit, bisphenol A ethylene oxide adduct unit, bisphenol A propylene oxide adduct unit, and glycerin unit.

The minimum melting point of the crystalline polyester is 20° C., preferably 25° C., and more preferably 30° C. When the melting point is low, it is difficult to produce capsulated particles, and the storage stability of a toner into which capsulated crystalline polyester was incorporated degrades. Meanwhile, the maximum melting point of the crystalline polyester is 80° C., preferably 60° C., and more preferably 50° C. When the maximum melting point is higher than 80° C., the addition effect to fixability is hardly exhibited.

<Resin (I) Different from Amorphous Resin (R)>

The Resin (I) is not particularly limited as long at it is different from the amorphous resin (R), and may be suitably selected. It is, however, preferably a resin incompatible with the amorphous resin (R). As such a resin (I), vinyl resins are exemplified.

As the resin (I), in view of using a crystalline polyester resin as the crystalline material (A), a resin having a skeleton which is hardly compatible with the crystalline polyester resin is preferable. A vinyl resin is preferable from the viewpoint of easy availability and ease of designing.

The vinyl resin can be obtained by polymerizing a monomer having a polymerizable double bond. Examples of such a monomer include styrene, α-methylstyrene, 4-methylstyrene, 4-ethylstyrene, 4-tert-butylstyrene, 4-methoxystyrene, 4-ethoxystyrene, 4-carboxystyrene, or metals salts thereof, 4-styrenesulfonic acid or metal salts thereof, 1-vinylnaphalene, 2-vinylnaphalene, allylbenzene, phenoxy alkylene glycol acrylate, phenoxy alkylene glycol methacrylate, phenoxy polyalkylene glycol acrylate, phenoxy polyalkylene glycol methacrylate, etc, (meth)acrylic acid, maleic acid (anhydride), monoalkyl maleate, fumaric acid, monoalkyl fumarate, crotonic acid, itaconic acid, monoalkyl itaconate, itaconic acid glycol monoether, citraconic acid, monoalkyl citraconate, cinnamic acid, etc.), sulfonic acid group-containing vinyl-based monomers, vinyl-based sulfur monoesters and salts thereof, phosphorous acid group-containing vinyl-based monomers and salts thereof.

[Capsule-Forming Method]

In the toner of the present invention, as a capsulation method of the crystalline material (A) such as a crystalline polyester resin which is present in the amorphous resin (R) in a state where it is capsulated by the resin (I), that is, as a method of forming a capsule which contains at least the crystalline material (A) and the resin (I), and formed by capsulation of the crystalline material (A) by the resin (I), the following methods are exemplified, for example: (1) fine particles of the crystalline material (A) are prepared preliminarily, and the circumference of the fine particles is coated with the resin (I); (2) after fine particles, in which the crystalline material (A) and a resin are dissolved in a solvent, are prepared, the solvent is removed therefrom, and capsules are formed while proceeding phase-separation of the crystalline material (A) and the resin (I); (3) the crystalline material (A) was dispersed as fine particles in a solvent in which the resin (I) has been dissolved to prepare a dispersion liquid of the fine particles, and then the solvent was removed therefrom to thereby produce a capsule which includes a crystalline material; and (4) a solution liquid in which the crystalline material (A) is dissolved in a monomer, or fine particles of a monomer solution in which the crystalline material (A) is dissolved in a monomer is obtained, and then the monomer is polymerized to prepare a resin, to thereby obtain a capsule in which the crystalline material (A) is capsulated by the resin (I). The method (4) is preferable because uniform capsules are easily obtained.

As the method of obtaining fine particles of a monomer solution, the method of dispersing the crystalline polymer resin in an aqueous medium is preferable because of ease of the subsequent polymerization process. As the subsequent polymerization process, to obtain capsulated particles to be made present in toner particles, a suspension polymerization and an mini-emulsion polymerization can be employed.

<Amorphous Resin (R): Binder Resin>

As the amorphous resin (R), i.e., the binder resin, a substance with at least part of which is soluble in an organic solvent is used. The acid value thereof is preferably 2 mgKOH/g to 24 mgKOH/g. When the acid value is higher than 24 mgKOH/g, transfer of the amorphous resin (R) to an aqueous phase easily occurs. As a result, a problem that a loss of material in/out flow inconveniently occurs in the course of the production process or the dispersion stability of the aqueous phase or oil droplets may degrade easily take place. Whereas, when the acid value is lower than 2 mgKOH/g, a colorant having a certain degree of polarity is hardly dispersed with uniformity in oil droplets because the polarity of the resin becomes low.

The type of the amorphous resin (R) is not particularly limited, however, when the color resin particles are used as an electrostatic image developing toner in electrophotography, the resin having a polyester skeleton is preferable in terms that excellent fixability can be obtained. Examples of the resin having a polyester skeleton include polyester resins, and block polymers obtained with polyester and a resin having a skeleton other than that of polymer. Among these, polyester resins are preferable in terms of high uniformity of the resulting color resin particles.

Examples of the polyester resin include ring-open polymers of lactones, polycondensation polymers of hydroxy carboxylic acids, and polycondensation products of polyol (1) with polycarboxylic acid (2). From the viewpoints of design freeness degree, polycondensation products of polyol with polycarboxylic acid are preferable.

The peak molecular weight of the polyester resin is typically 1,000 to 30,000, preferably 1,500 to 10,000, and more preferably 2,000 to 8,000. When the peak molecular weight of the polyester resin is less than 1,000, the heat resistant storage stability of the resulting toner degrades. Whereas, when it exceeds 30,000, the low temperature fixability as an electrostatic image developing toner degrades.

Further, the glass transition temperature of the polyester resin is 40° C. or higher, preferably 50° C. or higher, and more preferably 65° C. or higher. When the glass transition temperature is lower than 40° C., the resulting color resin particles may degrade or the color resin particles adhere to each other and may not do the inherent behavior when left in high-temperature environments, for example, in mid summer. Further, the glass transition temperature is 80° C. or lower, and more preferably 70° C. or lower. When the glass transition temperature exceeds 80° C., and when the color resin particles are used as an electrostatic image developing toner, the fixability degrades.

<<Polyol>>

As the polyol (1), a diol (1-1) and a trivalent or higher polyol (1-2), with use of (1-1) alone or use of a mixture of (1-1) and a small amount of (1-2) being preferable.

Examples of the diol (1-1) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenols such as bisphenol A, bisphenol F, and bisphenol S; alkylene oxide such as ethylene oxide, propylene oxide, and butylene oxide adducts of the alicyclic diols; and alkylene oxide such as ethylene oxide, propylene oxide, and butylene oxide adducts of the bisphenols; 4,4'-dihydroxyphenyls such as 3,3'-difluoro-4,4'-dihydroxybiphenyl; bis(hydroxyphenyl) alkanes (bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (another name: tetrafluoro bisphenol A), and 2,2-bis(3-hydroxyphenyl)-1,1,1,3,3,3-hexafluoropropane; bis(4-hydroxyphenyl)ethers such as bis(3-fluoro-4-hydroxyphenyl ether; and alkylene oxides of the bisphenols described above such as ethylene oxide, propylene oxide, butylene oxide adducts.

Among these, alkylene glycols having 2 to 12 carbon atoms, and alkylene oxide adducts of the bisphenols are preferable; and alkylene oxide adducts of the bisphenols, and combinations of alkylene oxide adducts of the bisphenols and alkylene glycols having 2 to 12 carbon atoms are particularly preferable.

Examples of the trivalent or higher polyol (1-2) include trivalent to octavalent or higher multivalent aliphatic alcohols (glycerin, trimethylolethane, trimethylolpropane, pentaerythritol, sorbitol, etc.); trivalent or higher phenols (trisphenol PA, phenol novolac, cresol novolac, etc.); and alkylene oxide adducts of the trivalent or higher polyphenols.

<<Polycarboxylic Acid>>

Examples of the polycarboxylic acid (2) include a dicarboxylic acid (2-1) and a trivalent or higher polycarboxylic acid (2-2), with use of (2-1) alone or use of a mixture of (2-1) and a small amount of (2-2) being preferable.

Examples of the dicarboxylic acid (2-1) include alkylene dicarboxylic acids (succinic acid, adipic acid, sebacic acid, etc.); alkenylene dicarboxylic acids (maleic acid, fumaric acid, etc.); and aromatic dicarboxylic acids (phthalic acid, isophthalic acid, terephthalic acid, naphthalenedicarboxylic acid, etc.); 3-fluoroisophthalic acid, 2-fluoroisophthalic acid, 2-fluoroterephthalic acid, 2,4,5,6-tetrafluoro-isophthalic acid, 2,3,5,6-tetrafluoro-terephthalic acid, 5-trifluoromethyl isophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic anhydride. Among these, alkenylene dicarboxylic acids having 4 to 20 carbon atoms, and aromatic dicarboxylic acids having 8 to 20 carbon atoms are preferable.

Examples of the trivalent or higher polycarboxylic acid (2-2) include aromatic polycarboxylic acids having 9 to 20 carbon atoms (trimellitic acid, pyromellitic acid, etc.). Additional examples of the polycarboxylic acid (2) include products prepared by means of reaction between acid anhydrides or lower alkyl esters (methyl ester, ethyl ester, isopropyl ester, etc.) of the above-mentioned compounds and the polyol (1).

The ratio of the polyol (1) to the polycarboxylic acid (2) is typically in the range of 2/1 to 1/2, preferably in the range of 1.5/1 to 1/1.5, more preferably in the range of 1.3/1 to 1/1.3, as the equivalent ratio of hydroxyl groups [OH] to carboxyl groups [COOH], i.e. [OH]/[COOH].

<<Modified Resin>>

In addition, in order to increase the dynamic strength of the resulting color resin particles, or the particles are used as an electrostatic developing toner, for the purpose of preventing high-temperature offset during fixing, in addition to increasing the dynamic strength, a modified resin having an isocyanate group at terminals may be dissolved to obtain color resin particles. Examples of a method of obtaining the modified resin include a method in which a resin is subjected to polymerization reaction together with a monomer containing an isocyanate group to thereby obtain a resin having an isocyanate group; and a method in which a resin having an active hydrogen group at terminals is obtained through polymerization and then reacted with polyisocyanate to thereby introduce the isocyanate group into terminals of the polymer. From the viewpoint of controllability of introducing an isocyanate group into terminals of the polymer, the latter method is preferably used. Examples of the active hydrogen group include hydroxyl group (alcoholic hydroxyl group, and phenolic hydroxyl group), amino group, carboxyl group, and mercapto group. Among these, alcoholic hydroxyl group is preferable. As the modified resin, in view of the uniformity of particles, a resin having the same skeleton as in the resin to be dissolved in the organic solvent is preferably used. Examples of such a modified resin are those having a polyester skeleton. As a method of obtaining a modified resin having an alcoholic hydroxyl group at terminals of polyester, in polycondensation of polyol with a polycarboxylic acid, the number of functional groups of the polyol is set to be higher than the number of functional groups of the polycarboxylic acid to thereby perform a polycondensation reaction.

<<Amine Compound>>

Part of the isocyanate group of the modified resin is hydrolyzed in the course of dispersing the oil phase in the aqueous phase to obtain particles to becomes an amino group, the generated amino group is reacted with the isocyanate group, and the elongation reaction proceeds. For the purpose of surely perform an elongation reaction other than the above-mentioned reaction, or introducing a crosslinking point, an amine compound can be used in combination. Examples of the amine compound (B) include diamine (B1), trivalent or higher polyamine (B2), amino alcohol (B3), aminomercaptane (B4), amino acid (B5), and blocked compounds (B6) in which the amino groups of B1 to B5 are blocked.

Examples of the diamines (B1) include aromatic diamines (phenylenediamine, diethyltoluenediamine, 4,4'-diaminodiphenylmethane, etc.); alicyclic diamines (4,4'diamino-3,3'-dimethyldicyclohexylmethane, diamine cyclohexane, isophoronediamine, etc.); and aliphatic diamines (ethylenediamine, tetramethylene diamine, hexamethylenediamine, etc.). Examples of the trivalent or higher polyamines (B2) include diethylenetriamine and triethylenetetramine.

Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid.

Examples of the compounds (B6) obtained by blocking amino groups of any one of (B1) to (B5) include ketimine compounds and oxazoline compounds derived from the amines of (B1) to (B5) and ketones (acetone, methyl ethyl ketone, methyl isobutyl ketone, etc.). Amongst the amines (B), (B1) and a mixture of (B1) and a small amount of (B2) are preferable.

As to the ratio of the amines (B), the number of amino groups [NHx] in the amines (B) is 4 times or less the number of isocyanate groups [NCO] in the prepolymer (A), preferably 2 times or less, more preferably 1.5 times or less, and particularly preferably 1.2 times or less. When the number of amino groups [NHx] in the amines (B) exceeds 4 times the number of isocyanate groups [NCO] in the prepolymer (A), an excessive amount of amino groups blocks isocyanate and an elongation reaction of the modified resin does not take place, and thus the molecular weight of the polyester is reduced, resulting in degradation in the hot offset resistance.

<Organic Solvent>

Preferably, the organic solvent is volatile and has a boiling point of lower than 100° C., from the viewpoint of ease of the subsequent desolvation treatment. Examples of such an organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, ethyl acetate, methylethylketone, and methyl isobutyl ketone. These may be used alone or in combination. When the resin to be dissolved or dispersed in the organic solve is a resin having a polyester skeleton, an ester-based solvent such as methyl acetate, ethyl acetate and butyl acetate or ketone-based solvent such as methylethylketone, and methyl isobutyl ketone is preferable because of their high solubility. Among these, from the viewpoint of having high desolvation properties (removal of solvent), methyl acetate, ethyl acetate and methylethylketone are particularly preferable.

<Aqueous Medium>

As the aqueous medium, water may be used alone, and a solvent miscible with water may be used in combination with water. Examples of the water-miscible solvent include alcohols (methanol, isopropanol, ethylene glycol, etc.), dimethyl formamide, tetrahydrofuran, cellosolves (methyl cellosolve, etc.), and lower ketones (acetone, methylethylketone, etc.).

<Surfactant>

A surfactant is used for producing liquid droplets by dispersing the oil phase in the aqueous medium.

Examples of the surfactant include anionic surfactants such as alkylbenzene sulfonate, α-olefin sulfonate, and phosphate ester; cationic surfactants such as an amine salt type (for example, alkylamine salt, aminoalcohol fatty acid derivative, polyamine fatty acid derivative, and imidazoline) and a quaternary ammonium salt surfactant (for example, alkyltrimethyl ammonium salt, dialkyldimethyl ammonium salt, alkyldimethylbenzyl ammonium salt, pyridinium salt, alkylisoquinolinium salt, benzethonium chloride); nonionic surfactants such as fatty acid amide derivative and polyalcohol derivative; and amphoteric surfactants such as alanine, dodecyldi(aminoethyl)glycine, di(octylamioethyl)glycine, and N-alkyl-N,N-dimethyl ammonium betaine. Among these surfactants, surfactants with fluoroalkyl group are preferable in terms that even in a very small amount thereof, the effect of the use can be improved.

Examples of anionic surfactants having a fluoroalkyl group include fluoroalkylcarboxylic acid having 2 to 10 carbon atoms and a metal salt thereof, disodium perfluorooctanesulfonylglutamate, sodium 3-[ω-fluoro(C6-C11)alkyloxy]-1-(C3-C4)alkyl sulfonate, sodium 3-[ω-fluoro(C6-C8)alkanoyl-N-ethylamino]-1-propanesulfonate, fluoro(C11-C20)alkylcarboxylic acid and a metal salt thereof, perfluoro(C7-C13)alkylcarboxylic acid and a metal salt thereof, perfluoro(C4-C12)alkylsulfonic acid and a metal salt thereof, perfluorooctanesulfonic acid diethanol amide, N-propyl-N-(2-hydroxyethyl) perfluorooctanesulfonamide, a perfluoro(C6-C10)alkylsulfonamidepropyltrimethylammonium salt, a perfluoro(C6-C10)alkyl-N-ethylsulfonylglycine salt, and monoperfluoro(C6-C16)alkylethylphosphate ester.

Furthermore, examples of cationic surfactants having a fluoroalkyl group include aliphatic primary amine acid, aliphatic secondary amine acid each having a fluoroalkyl group; an aliphatic quaternary ammonium salt such as a perfluoro(C6-C10)alkylsulfonamidepropyltrimethyl ammonium salt; a benzalkonium salt, benzethonium chloride, a pyridinium salt, and an imidazolinium salt.

<Inorganic Dispersant>

A solution or dispersion of the toner composition may be intermediately dispersed in the aqueous medium in the presence of an inorganic dispersant or resin fine particles. As the inorganic dispersant, tricalcium phosphate, calcium carbonate, titanium oxide, colloidal silica or hydroxyapatite can also be used as the dispersant. Among these, dispersants are preferable from the viewpoint that a sharp particle size distribution is obtained and the dispersion is stably performed.

<Protective Colloid>

Dispersed droplets may be stabilized by a polymeric protective colloid.

Examples of the polymeric protective colloid include homopolymers or copolymers of polymerizable compound such as (meth)acrylic monomers containing an acid or hydroxyl group, vinyl alcohols, ethers with vinyl alcohol, esters of vinyl alcohol with a compound containing a carboxyl group, acrylamides, methylol compounds of acrylamides, acid chlorides, and homopolymers and copolymers of a polymerizable compound such as a compound containing a nitrogen atom or a heterocyclic ring thereof, polyoxyethylenes; and celluloses.

Examples of the acids include acrylic acid, methacrylic acid, α-cyanoacrylic acid, α-cyanomethacrylic acid, itaconic acid, crotonic acid, fumaric acid, maleic acid and maleic anhydride.

Examples of the acrylic monomer containing a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerin monoacrylic ester, glycerin monomethacrylic ester, N-methylolacrylamide and N-methylolmethacrylamide.

Examples of the ethers with vinyl alcohol include vinyl methyl ether, vinyl ethyl ether and vinyl propyl ether.

Examples of the esters of vinyl alcohol and a compound containing a carboxyl group include vinyl acetate, vinyl propionate and vinyl butyrate.

Examples of the acrylamides include acrylamide, and methacrylamide, diacetone acrylamide.

Examples of the acid chlorides include acryloyl chloride and methacryloyl chloride.

Examples of the compound containing a nitrogen atom or heterocyclic ring thereof include vinylpyridine, vinylpyrrolidone, vinylimidazole and ethyleneimine.

Examples of the polyoxyethylenes include polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester and polyoxyethylene nonyl phenyl ester.

Examples of the celluloses include methyl cellulose, hydroxyethyl cellulose and hydroxypropyl cellulose.

In the case where a dispersion stabilizer, such as calcium phosphate, that is soluble in acids or bases is used, the dispersion stabilizer is, for example, dissolved in an acid such as hydrochloric acid, and then the dispersion stabilizer is removed from fine particles by means of washing or the like. Alternatively, the dispersion stabilizer can be removed by means of decomposition produced by an enzyme, for example. In the case where a dispersant is used, although the dispersant can be left on surfaces of toner particles, it is desirable, in terms of the chargeability of the toner, that the dispersant be washed away after elongation reaction and/or crosslinking reaction is over.

<Colorant>

The colorant used in the present invention is not particularly limited and may be suitably selected from among known dyes and pigments. Examples of the colorant include carbon black; azine pigments, metal salt azo pigments, metal oxides and metal complex oxides such as oil furnace black, channel black, lamp black, acetylene black, aniline black; Nigrosin dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, colcothar, red lead oxide, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, lithopone, and mixtures thereof. These colorants may be used alone or in combination.

<Formation of Colorant Masterbatch>

The colorant may also be used as a masterbatch obtained by combining with a resin. Examples of such a resin include, besides the modified or unmodified polyester resins described above, styrene or polymers of substitution product thereof (e.g., polystyrene, poly(p-chlorostyrene), and polyvinyltoluene; styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer); polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic resin, rosin, modified rosin, terpene resin, aliphatic hydrocarbon resin, alicyclic hydrocarbon resin, aromatic resin, chlorinated paraffin, and paraffin wax. These resins may be used alone or in combination.

<Production Method of Masterbatch>

The masterbatch can be obtained by mixing and kneading the resin for masterbatch and the colorant under application of high shear force. On that occasion, it is preferable to use an organic solvent to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a three roll mill is preferably used.

The toner of the present invention may contain the following other components as required.

<Releasing Agent>

When the color resin particles were used as a latent electrostatic developing toner, a releasing agent may be dispersed in the organic solvent for the purpose of improving the fixing releasability.

As the releasing agent, a material such as a wax or silicone oil, where has sufficiently low viscosity when heated in a fixing process and hardly compatible with other materials other than the color resin particles and with the surface of a fixing member and hardly swellable is used. In consideration of the storage stability of the color resin particles, generally, a wax, which is present as a solid in a color resin particles during storage, is preferably used.

Examples of the wax include a long-chain hydrocarbon and a carbonyl group-containing wax. Examples of the long-chain hydrocarbon include polyolefin waxes (e.g., polyethylene wax, and polypropylene wax); petroleum waxes (e.g., paraffin wax, Sazole wax, and microcrystalline wax); and Fischer Tropic wax.

Examples of the carbonyl group-containing wax include polyalkane acid ester (e.g., carnauba wax, trimethylolpropane tribehenate, pentaerythritol terabehenate, pentaerythritol diacetate dibehenate, glycerin tribehenate, and 1,18-octadecanediol distearate); polyalkanol ester (e.g., trimellitic acid tristearyl, and distearyl maleate); polyalkanone acid amide (e.g., ethylene diamine dibehenylamide); polyalkylamide (e.g., trimellitic tristearylamide); and dialkylketone (e.g., distearylketone).

Among these, long-chain hydrocarbon is preferable in terms of excellent in releasability. When a long-chain hydrocarbon is used as a releasing agent, a carbonyl group-containing wax may be used in combination. The amount of the releasing agent is 2% by mass to 25% by mass, preferably 3% by mass to 20% by mass, and more preferably 4% by mass to 15% by mass in the color resin particles. When the amount of the releasing agent is less than 2% by mass, the effect of improving the fixability cannot be exhibited, and whereas when the amount thereof exceeds 25% by mass, the mechanical strength of the color resin particles degrades.

<Charge Controlling Agent>

Further, when necessary, a charge controlling agent may be dissolved or dispersed in the organic solvent.

As the charge controlling agent, any known charge controlling agents can be used. Examples of the charge controlling agent include nigrosin dyes, triphenylmethane dues, chrome-containing metal complex dyes, molybdenum acid chelate pigments, Rhodamine dyes, alkoxy-based amines, quaternary ammonium salts (including fluorine-modified quaternary ammonium salts), alkylamide, single substance or compounds of phosphorus, single substance or compounds of tungsten, fluorine-based active agents, metal salicylates, and metal salts of salicylic acid derivatives. Specifically, examples of commercially available products of the charge controlling agent include BONTRON 03 (Nigrosine dye), BONTRON P-51 (quaternary ammonium salt), BONTRON S-34 (metal-containing azo dye), BONTRON E-82 (oxynaphthoic acid metal complex), E-84 (salicylic acid metal complex), and E-89 (phenolic condensates), which are manufactured by Orient Chemical Industries, Ltd.; TP-302 and TP415 (quaternary ammonium salt molybdenum complex), which are manufactured by Hodogaya Chemical Co., LTD.; COPY CHARGE PSY VP2038 (quaternary ammonium salt), COPY BLUE PR (triphenylmethane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments; and polymeric compounds having a functional group such as a sulfonate group, a carboxyl group, or a quaternary ammonium salt group. The charge controlling agent may be used in an amount range with the performance thereof being appropriately exhibited and without impairing the fixability. Specifically, the charge controlling agent content in the toner is preferably 0.5% by mass to 5% by mass, and more preferably 0.8% by mass to 3% by mass.

(Toner Production Method)

Next, the toner production method will be described.

A toner production method according to the present invention includes forming a capsule by capsulating a crystalline material (A) by a resin (I), where the capsule contains at least the crystalline material (A) and the resin (I), and dispersing the capsule in an amorphous resin (R), wherein the crystalline material (A) is compatible with the amorphous resin (R) and has a melting point of 80° C. or lower.

Further, the toner production method of the present invention preferably further includes mixing a first dispersion liquid in which the capsule is dispersed in an aqueous medium, a second dispersion liquid in which the amorphous resin (R) is dispersed in an aqueous medium, and a third dispersion liquid containing colorant particles, adding an aggregation agent to the dispersion liquid so that aggregated particles are formed by the capsule, the amorphous resin (R) and the colorant particles, and allowing the aggregated particles to coalesce by increasing the temperature thereof.

Alternatively, the toner production method of the present invention preferably further includes dissolving or dispersing, in an organic solvent, at least the capsule, the amorphous resin (R), and the colorant to prepare an oil phase, preparing an aqueous phase containing at least a surfactant in the aqueous medium, dispersing the oil phase in the aqueous phase to prepare a dispersion liquid in which particles formed of the oil phase are dispersed, removing the organic solvent from the dispersion liquid, washing the particles, and drying the particles to removed water therefrom.

Specific examples of each of these steps will be described in detail.

<Capsule Forming Step>

As the capsule forming step, the above-mentioned capsule forming method can be employed.

<Oil Phase Preparation Step>

As a method of producing an oil phase where resins, and a colorant etc. are dissolved or dispersed in an organic solvent, the resins and colorant may be gradually added into an organic solvent while stirring so as to be dissolved or dispersed therein. Note that when a pigment is used as a colorant, or when a releasing agent and/or a charge controlling agent which are sparsely dissolved in an organic solvent is or are added, it is preferably to make particles smaller before addition to the organic solvent.

As described above, formation of a colorant-containing masterbatch is one of the measures, the same method can be used for the releasing agent and charge controlling agent.

As another method, it is also possible to obtain a wet master by adding a dispersion aid in an organic solvent and dispersing a colorant, a releasing agent and a charge controlling agent therein through a wet process.

As still another method, when a material which is dissolved at a temperature lower than the boiling point of the organic solvent is dispersed, the following method may be employed.

That is, a dispersion aid is added, as required, in the organic solvent, and heated while stirring together with the dispersion medium to be dispersed once in the organic solvent, and then cooled while stirring or applying a shearing force to crystallize the system, thereby producing fine crystals of the dispersion medium.

The colorant, releasing agent and charge controlling agent that are dispersed using the method described above are dissolved or dispersed together with resins, and then these materials may be further dispersed. On the occasion of the dispersion, a known dispersion device such as a bead mill and disc mill may be used.

<Particle Forming Step>

A method of preparing a dispersion liquid in which the oil phase obtained in the step described above is dispersed in an aqueous medium containing at least a surfactant to prepare a dispersion liquid in which particles made of the oil phase are dispersed is not particularly limited. Known equipment such as a low-speed shearing system, a high-speed shearing system, a frictional type system, a high-pressure jetting system, or ultrasonic wave may be used. To adjust the particle diameter of the dispersion to 2 μm to 20 μm, a high-speed shearing system is preferable. The temperature of the dispersion is typically 0° C. to 40° C., and more preferably 10° C. to 30° C. When the temperature is higher than 40° C., the move of the molecules is activated, and thereby the dispersion stability degrades, and unfavorably, aggregates and coarse particles easily occur. Whereas, when the temperature is lower than 0° C., the viscosity of the dispersion increases, the shearing energy necessary for the dispersion treatment is increased, and thus the production efficiency decreases.

<Capsule Dispersing Step>

The method of introducing the capsules in the toner is not particularly limited and may be suitably selected. For example, there may be exemplified a method of adding the dispersion of capsules in the oil phase, and a method in which the dispersion of capsules is preliminarily added in the aqueous phase and then incorporated into the oil phase during the dispersion of the oil phase. Of these methods, from the viewpoint that the capsulated crystalline material can be surely incorporated into the oil phase, the method of adding the dispersion of capsules in the oil phase is preferable.

<Desolvation Step>

To remove the organic solvent from the resulting color resin dispersion, a method can be employed in which the temperature of the system is gradually increased while stirring to completely evaporate the organic solvent in liquid droplets.

Also, the color resin dispersion may be sprayed in a dry atmosphere while stirring to thereby completely remove the organic solvent in liquid droplets. In addition, the color resin dispersion may be depressurized while stirring to thereby remove the organic solvent therefrom. Each of the later two methods may be used in combination with the method described first.

As the dry atmosphere in which the emulsified dispersion is sprayed, gases that is obtained by heating air, a nitrogen gas, a carbon gas, a combustion gas or the like, in particular, various air streams heated to a temperature equal to or higher than the boiling point of a solvent having the highest boiling point are generally used. With a short-time treatment using a spray drier, belt drier, or rotary kiln, sufficient intended quality can be obtained.

<<Aging Step>>

When a modified resin having an isocyanate group in terminals is added, aging may be performed to make chain-elongation-crosslinking reaction of isocyanate proceed. The aging time is generally 10 minutes to 40 hours, and more preferably 2 hours to 24 hours. The reaction temperature is generally 0° C. to 40° C., and more preferably 15° C. to 30° C.

<Washing Step>

Since the dispersion liquid of color resin particles obtained by the method described above contains secondary-materials such as dispersant (e.g., surfactant) besides the color resin particles, the dispersion liquid is washed to take out only the color resin particles. The method of washing the color resin particles is not particularly limited and may be suitably selected in accordance with the intended use. Examples of the method include a centrifugal separation method, a depressurization filtration method, and a filter press method. A cake of color resin particles can be obtained by any of these methods. When the color resin particles cannot be sufficiently washed with one-time washing treatment, the resulting cake may be dispersed again in the aqueous solvent to make a slurry, followed by repeatedly performing the step of taking out the color resin particles through any one of the methods described above. When washing is performed through a depressurization filtration method or a filter press method, a method may be employed in which the aqueous solvent is made penetrate through the resulting cake so as to wash out secondary materials held by the color resin particles. For the aqueous solvent for use in this washing, water or a mixture solvent containing alcohol (e.g., methanol, and ethanol) in water is used. In view of costs, and environmental loads such as water-waste treatment, water is preferably used.

<Drying Step>

The washed color resin particles holds a large amount of the aqueous medium, and thus the color resin particles are dried to remove the aqueous medium therefrom, and thereby only the color resin particles can be obtained. As the drying method, various driers such as a spray drier, a vacuum frozen drier, a depressurization drier, a static shelf drier, a portable type shelf drier, a fluidization type bath drier, a rotational type drier, and a stirring type drier can be used. The dried color resin particles are preferably dried until the water content is finally less than 1% by mass. In addition, the color resin particles after drying are soft-aggregated, and when there is any inconvenience in use, the soft-aggregated color resin particles may be shredded by utilizing a device such as a jet mill, HENSCHEL MIXER, super mixer, coffee mill, Auster blender, and food processor to thereby disentangle soft aggregates.

[Measurement of Particle Diameter of Colorant Resin Particles]

The volume average particle diameter of the colorant resin particles is measured by the Coulter Counter method. Examples of the measurement device include Coulter Counter TA-II, Coulter MULTISIZER II, and Coulter MULTISIZER III (all manufactured by Coulter Inc.). The following describes the measurement method.

Firstly, in 100 mL to 150 mL of electrolyte aqueous solution, 0.1 mL to 5 mL of a surfactant (preferably, alkylbenzene sulfonic acid salt) is added as a dispersant. Here, the electrolyte aqueous solution is prepared by formulating an about 1% NaCl aqueous solution using a primary sodium chloride. For example, ISOTON-II (produced by Coulter Inc.) can be used. A measurement sample (2 mg to 20 mg) is further added thereto. The electrolyte liquid in which the sample is suspended is then subjected to a dispersion treatment for about 1 minute to about 3 minutes in a ultrasonic wave dispersing machine. Using an aperture having an aperture diameter of 100 μm of the device, the volume and the number of particles of toner particles or the toner are measured to calculate a volume distribution and a number distribution. From the obtained distributions, the volume average particle diameter and the number average particle diameter can be determined.

In the measurement, the following 13 channels were used to measure particles having diameters of 2.00 μm or greater but smaller than 40.30 μm: a channel having a diameter of 2.00 μm or larger but smaller than 2.52 μm, a channel having a diameter of 2.52 μm or larger but smaller than 3.17 μm; a channel having a diameter of 3.17 μm or larger but smaller than 4.00 μm; a channel having a diameter of 4.00 μm or larger but smaller than 5.04 μm; a channel having a diameter of 5.04 μm or larger but smaller than 6.35 μm; a channel having a diameter of 6.35 μm or larger but smaller than 8.00 μm; a channel having a diameter of 8.00 μm or larger but smaller than 10.08 μm; a channel having a diameter of 10.08 μm or larger but smaller than 12.70 μm; a channel having a diameter of 12.70 μm or larger but smaller than 16.00 μm; a channel having a diameter of 16.00 μm or larger but smaller than 20.20 μm; a channel having a diameter of 20.20 μm or larger but smaller than 25.40 μm; a channel having a diameter of 25.40 μm or larger but smaller than 32.00 μm; and a channel having a diameter of 32.00 μm or larger but smaller than 40.30 μm.

[Measurement of Particle Diameter of Vinyl-Based Resin Fine Particles]

The particle diameter of resin fine particles was measured using a UPA-150EX (Nikkiso Co., Ltd.).

Measurement parameters are as follows:

Transparency of particles: Transparent

Refractive Index of particles: 1.59

Shape of Particles: spherical shape

Solvent type: WATER

Monodisperse: invalid

The particle diameter of resin fine particles was measured above-mentioned conditions with controlling the sample concentration so that the loading index became within a range of 1 to 1.5.

[Measurement of Molecular Weight (GPC)]

The measurement of molecular weight of the resin was measured by GPC (gel permeation chromatography) under the following conditions:

Device: GPC-150C (manufactured by Waters Instruments, Inc.)

Column: KF801 to KF807 (manufactured by Showdex Co.)

Temperature: 40° C.

Solvent: THF (tetrahydrofuran)

Rate of flow: 1.0 mL/min

Sample: 0.1 mL of a sample having a concentration of 0.05% by mass to 0.6% by mass was injected.

From the molecular weight distribution of the resin measured under the above conditions, a molecular weight calibration curve prepared using a monodispersed polystyrene standard sample, the number average molecular weight and the weight average molecular weight of the resin were calculated. As the monodispersed polystyrene standard sample, Std. No S-7300, S-210, S-390, S-875, S-1980, S-10.9, S-629, S-3.0, S-0.580 of Showdex STANDARD series produced by Showa Denko Co., Ltd., and toluene were used. As a detection device, an RI (refractive index) detector was used.

[Measurement of Glass Transition Temperature (Tg) (DSC)]

As a device for measuring Tg, a TG-DSC system TAS-100 manufactured by Rigaku Denki Co., Ltd. was used.

Firstly, about 10 mg of a sample was placed in an aluminum sample container, the sample container was loaded on a holder unit and then placed in an electric oven. Next, the sample was heated to 150° C. at an temperature increase rate of 10° C./min, and then left standing at 150° C. for 10 minutes. Thereafter, the sample is cooled and left standing for 10 minutes, heated again to 150° C. at a temperature increase rate of 10° C./min, and the DSC curve was measured. The Tg of the sample was calculated from a contact point between a tangent line of an endothermic peak curve in the vicinity of TG and the base line, using analysis software in the TAS-100 system.

(Process Cartridge)

A process cartridge according to the present invention is a process cartridge including, as an integral unit, a photoconductor and at least a device configured to develop a latent image on the photoconductor with a developer, and which is detachably mounted on an image forming apparatus, wherein the developer contains a toner according to the present invention.

Figure 2:
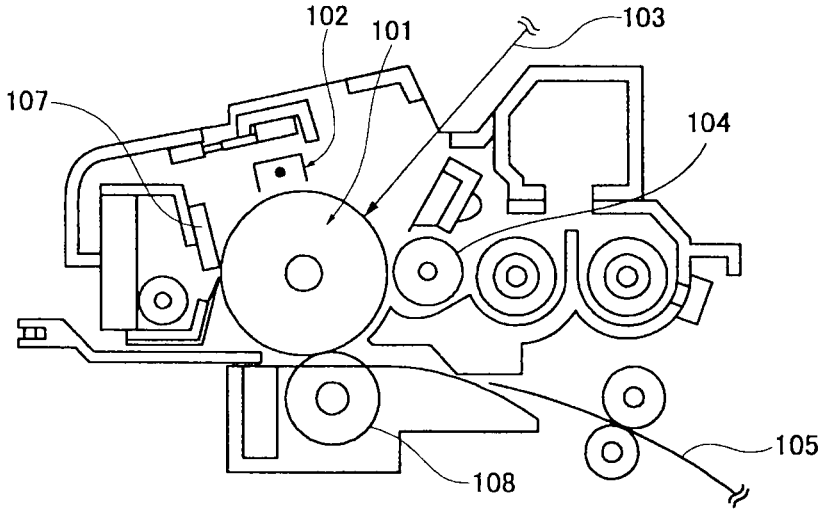
FIG. 2 is a diagram schematically illustrating the construction of a process cartridge according to the present invention.

The process cartridge includes, for example, as illustrated in FIG. 2, a latent image bearing member 101 internally, includes a charger 102, a developer 104, a cleaning unit 107, and further includes other units as required. In FIG. 2, reference numeral 103 denotes exposure light from an exposing unit, and reference numeral 105 denotes a recording paper sheet. As the latent image bearing member 101, the one having a same configuration as in the above-mentioned image forming apparatus can be used. As the charger 102, an arbitrarily selected charging member is used.

Hereinbelow, an image forming process using the process cartridge illustrated in FIG. 2 will be described. While rotating in a direction indicated by an arrow in the figure, the latent image bearing member 101 undergoes charging by the charger 102, and the exposure light 103 from an exposing unit (not illustrated) to thereby receives, on its surface, a latent electrostatic image corresponding to an exposed image. This latent electrostatic image is developed with a toner by the developer 104, the developed toner image is transferred onto the recording paper sheet 105 by a transfer roller 108 to be printed out. Next, a surface of the latent image bearing member 101 after image transfer is cleaned by the cleaning unit 107, further electrically discharged by a charge eliminating device (Not illustrated). The above-mentioned operation is, again, repeatedly performed.

EXAMPLES

Hereinafter, the present invention will be further described in detail with reference to Examples, which however shall not be construed as limiting the scope of the present invention. Note that the unit "part(s)" in Examples means "part(s) by mass".

[Synthesis of Polyester 1]

In a reaction vessel equipped with a condenser, a stirrer and a nitrogen inlet tube, 778 parts of propylene oxide (2 mol) adduct of bisphenol A, 208 parts of terephthalic acid, 23 parts of isophthalic acid, 24 parts of adipic acid and 2 parts of dibutyltin oxide were charged and reacted under normal pressure at 230° C. for 8 hours. Next, the reaction product was further reacted under reduced pressure of 10 mmHg to 15 mmHg for 5 hours, and then 44 parts of trimellitic anhydride were added to the reaction vessel, followed by reaction under normal pressure at 180° C. for 2 hours, to thereby synthesize [Polyester 1].

The resulting [Polyester 1] was found to have a number average molecular weight of 2,400, a weight average molecular weight of 6,800, a glass transition temperature of 43° C., and an acid value of 24 mgKOH/g.

[Synthesis of Crystalline Polyester Resin (1)]

Adipic acid (294 parts), 248 parts of ethylene glycol, and 0.12 parts of dibutyltin oxide were stirred under nitrogen atmosphere at 180° C. for 6 hours. Thereafter, the mixture was stirred for 4 hours while reducing the pressure to thereby obtain a crystalline polyester resin [Crystalline Polyester Resin (1)] having a weight average molecular weight (Mw) of 19,900, and a number average molecular weight (Mn) of 7,800. Crystalline Polyester Resin (1) was measured for its melting point, using a differential scanning calorimeter (DSC) and found to have a definite peak. The peak top temperature was 47° C.

[Synthesis of Crystalline Polyester Resin (2)]

Adipic acid (146 parts), 175 parts of 1,10-decanediol, and 0.12 parts of dibutyltin oxide were stirred under nitrogen atmosphere at 180° C. for 6 hours. Thereafter, the mixture was stirred for 4 hours while reducing the pressure to thereby obtain a crystalline polyester resin [Crystalline Polyester Resin (2)] having a weight average molecular weight (Mw) of 16,700, and a number average molecular weight (Mn) of 6,500.

Crystalline Polyester Resin (2) was measured for its melting point, using a differential scanning calorimeter (DSC) and found to have a definite peak. The peak top temperature was 69° C.

[Synthesis of Crystalline Polyester Resin (3)]

Adipic acid (232 parts), 238 parts of 1,6-hexanediol, and 0.12 parts of dibutyltin oxide were stirred under nitrogen atmosphere at 180° C. for 6 hours. Thereafter, the mixture was stirred for 4 hours while reducing the pressure to thereby obtain a crystalline polyester resin [Crystalline Polyester Resin (3)] having a weight average molecular weight (Mw) of 22,200, and a number average molecular weight (Mn) of 7,000. Crystalline Polyester Resin (3) was measured for its melting point, using a differential scanning calorimeter (DSC) and found to have a definite peak. The peak top temperature was 113° C.

[Production of Resin Dispersion Liquid 1]

In 281 parts of ion exchanged water, 0.4 parts of sodium dodecyl sulfate were added and heated at 70° C. so as to be dissolved, thereby obtaining an aqueous medium. Separately, 30 parts of styrene monomer, 30 parts of methyl methacrylate, 5 parts of butyl acrylate, 2 parts of methacrylic acid and 33 parts of [Crystalline Polyester 1] were stirred under nitrogen atmosphere while being heated at 80° C. to thereby obtain a uniform monomer solution.

The resulting monomer solution was added to the aqueous medium, and then subjected to ultrasonic wave irradiation at 90 W to 110 W for 10 minutes while the temperature thereof being maintained at 80° C. under nitrogen atmosphere, using a ultrasonic homogenizer VCX750, so that the monomer was dispersed in the aqueous medium. In the course of this process, although the liquid temperature was increased by ultrasonic wave irradiation, the liquid temperature was controlled to be within a range of 75° C. to 85° C. by a water bath, etc. The resulting dispersion liquid was transferred to a reaction vessel equipped with a condenser, a stirrer and a nitrogen inlet tube, the temperature thereof was maintained at 80° C. while stirring, and a solution in which 0.5 parts of potassium persulfate were dissolved in 19 parts of ion exchanged water, was added to the dispersion liquid, followed by a polymerization reaction for 180 minutes.

Subsequently, the reaction product was cooled to thereby obtain a white resin fine particle dispersion liquid [Resin Dispersion Liquid 1] having a volume average particle diameter of 157 nm.

Fine particles in the resulting resin dispersion liquid were embedded by an embedding resin, and the embedded resin was sliced by a microtome to prepare a thin section. The thin section was observed through a scanning transmission microscope, and it was confirmed that the resin fine particles had a capsule structure.

[Production of Resin Dispersion Liquid 2]

Resin Dispersion Liquid 2 was obtained in the same manner as in Resin Dispersion Liquid 1, except that Crystalline Polyester 1 was changed to Crystalline Polyester 2.

[Production of Resin Dispersion Liquid 3]

Resin Dispersion Liquid 3 was obtained in the same manner as in Resin Dispersion Liquid 1, except that Crystalline Polyester 1 was changed to Crystalline Polyester 3.

[Production of Resin Dispersion Liquid 4]

Resin Dispersion Liquid 4 was obtained in the same manner as in Resin Dispersion Liquid 1, except that Crystalline Polyester 1 was changed to methyl stearate (melting point: 39° C.).

[Production of Resin Dispersion Liquid 5]

Resin Dispersion Liquid 5 was obtained in the same manner as in Resin Dispersion Liquid 1, except that Crystalline Polyester 1 was changed to lauric acid (melting point: 44° C.).

[Production of Resin Dispersion Liquid 6]

Resin Dispersion Liquid 6 was obtained in the same manner as in Resin Dispersion Liquid 1, except that Crystalline Polyester 1 was changed to myristic acid (melting point: 55° C.).

[Production of Resin Dispersion Liquid 7]

Resin Dispersion Liquid 7 was obtained in the same manner as in Resin Dispersion Liquid 1, except that Crystalline Polyester 1 was changed to ethylene glycol distearate (melting point: 63° C.).

[Production of Resin Dispersion Liquid 8]

Resin Dispersion Liquid 8 was obtained in the same manner as in Resin Dispersion Liquid 1, except that Crystalline Polyester 1 was changed to pentaerythritol tetrabehenate (melting point: 83° C.).

[Production of Resin Dispersion Liquid 9]

styrene 282 parts
n-butyl acrylate 118 parts
acrylic acid 12 parts
octanethiol 10 parts The materials described above were mixed and dissolved to prepare a solution, and this solution was dispersed and emulsified, in a flask, in a solution in which 6 parts of a nonionic surfactant (produced by Sanyo Chemical Industries, Ltd., NONIPOLE 400) and 10 parts of an anionic surfactant (produced by DAI-ICHI KOGYO SEIYAKU CO., LTD., NEOGEN SC) were dissolved in 560 parts of ion exchanged water. While the emulsified dispersion liquid being slowly mixed for 10 minutes, 50 parts of ion exchanged water, into which 4 parts of ammonium persulfate had been dissolved, were charged, and the flask was substituted with nitrogen. The materials in the flask were heated to 70° C. by an oil bath while being stirred, and then subjected to emulsification polymerization for 5 hours.

Through the above process, Resin Dispersion Liquid 9 (concentration of resin particles: 40% by mass) was prepared, in which resin fine particles having a volume average particle diameter of 180 nm, a glass transition temperature of 59° C., and a weight average molecular weight (Mw) of 33,000 were dispersed.

Example 7

Production of Resin Dispersion Liquid 10

Resin Dispersion Liquid 10 was obtained in the same manner as in Resin Dispersion Liquid 1, except that Crystalline Polyester was changed to N-[2-(diethylamino)ethyl]stearamide (melting point: 54° C.), and the addition amount of sodium dodecyl sulfate was changed from 0.4 parts to 0.5 parts).

[Production of Releasing Agent-Dispersion Liquid]

The following composition was mixed and heated to 97° C., and then dispersed by a ULTRA TALAX T50 manufactured by IKA Co.

Thereafter, the resulting composition liquid was subjected to dispersion treatment, 20 times, by a GAULIN homogenizer (available from Meiwa Shoji Co., Ltd.) at 105° C. and 550 kg/cm$^2$, thereby obtaining a releasing agent-dispersion liquid having a center diameter of 190 nm.

paraffin wax (produced by Nippon Seiro Co., Ltd., HNP-09) 100 g anionic surfactant NEOGEN SC 5 g ion exchanged water 300 g

[Production of Cyan Pigment Dispersion Liquid]

The following composition was mixed. Dissolved, and then dispersed by a homogenizer (IKA ULTRA TALAX) and through ultrasonic wave irradiation to obtain a blue pigment dispersion liquid having a center particle diameter of 150 nm.

cyan pigment (C.I. Pigment Blue 15:3) 50 g (copper phthalocyanine produced by Dainippon Ink Chemical Industries Co., Ltd.)

anionic surfactant NEOGEN SC 5 g ion exchanged water 200 g

[Synthesis of Prepolymer]

In a reaction vessel equipped with a condenser, a stirrer and a nitrogen inlet tube, 682 parts of ethylene oxide (2 mol) adduct of bisphenol A, 81 parts of propylene oxide (2 mol) adduct of bisphenol A, 283 parts of terephthalic acid, 22 parts trimellitic anhydride and 2 parts of dibutyltin oxide were charged and reacted under normal pressure at 230° C. for 8 hours. Then, the reaction product was further reacted under reduced pressure of 10 mmHg to 15 mmHg for 5 hours to obtain [Intermediate Polyester 1]. [Intermediate Polyester 1] was found to have a number average molecular weight of 2,100, a weight average molecular weight f 9,500, a glass transition temperature (Tg) of 55° C., an acid value of 0.5 mgKOH/g, and a hydroxyl value of 49 mg KOH/g.

Next, in a reaction vessel equipped with a condenser, a stirrer and a nitrogen inlet tube, 411 parts of [Intermediate Polyester 1], 89 parts of isophorone diisocyanate and 500 parts of ethyl acetate were charged and reacted at 100° C. for 5 hours to obtain [Prepolymer 1]. [Prepolymer 1] was found to have a free isocyanate content of 1.53% by mass.

[Production of Masterbatch 1]

Carbon black (40 parts), Polyester 1 (60 parts) and water (30 parts) were mixed by a HENSCHEL MIXER to obtain a mixture in which water went through pigment aggregates. This mixture was kneaded for 45 minutes by a two-roll with the surface temperature being set to 130° C., and then pulverized by a pulverizer to obtain [Masterbatch 1] of 1 mm in size.

Example 1

Preparation of Aqueous Phase

Ion exchanged water (970 parts), 40 parts of a 25% by mass aqueous dispersion liquid containing organic resin fine particles for dispersion stabilization (a copolymer of ethylene oxide adduct of styrene-methacrylic acid-butyl acrylate-methacrylic acid-sodium sulfate), 95 parts of a 48.5% aqueous solution of dodecyldiphenylether disulfonate, and 98 parts of ethyl acetate were mixed and stirred to obtain [Aqueous Phase 1].

<Preparation of Oil Phase>

Into a vessel equipped with a stirrer, and a thermometer, [Polyester 1] (545 parts), [Paraffin wax (melting point: 74° C.)] (181 parts), and ethyl acetate (1,450 parts) were charged. The temperature of the system was increased to 80° C. with stirring and maintained at 80° C. for 5 hours. Subsequently, the system cooled to 30° C. in 1 hour. Next, into a vessel, [Masterbatch 1] (500 parts), and ethyl acetate (100 parts) were charged, and mixed for 1 hour to obtain [Material Solution 1].

[Material Solution 1] (1,500 parts) was transferred to the vessel and passed three times through a bead mill, ULTRA VISCOMILL (manufactured by Aimex Co., Ltd.) under the following conditions: liquid feed rate: 1 kg/hr, disc circumferential speed: 6 m/sec, 0.5 mm-zirconia bead filled at 80% by volume, so that the pigment and the wax were dissolved. Next, a 66% ethyl acetate solution of [Polyester 1] (655 parts) was added to the solution and passed once through the bead mill under the conditions described above to obtain [Pigment-Wax Dispersion Liquid 1].

[Pigment-Wax Dispersion Liquid 1] (976 parts), and isophorone diamine (2.6 parts) were mixed in a TK Homomixer (manufactured by PRIMIX Corporation) at 5,000 rpm for 1 minute. Subsequently, [Resin Dispersion Liquid 1] (596 parts) was added to the mixture and mixed at 8,000 rpm for 1 minute, and [Isocyanate-Modified Polyester 1] (88 parts) was added thereto, followed by mixing by a TK Homomixer (manufactured by PRIMIX Corporation) at 5,000 rpm for 1 minute, to thereby obtain [Oil Phase 1].

<Production of Particles>

[Aqueous Phase 1] (1,100 parts) was added to the resulting [Oil Phase 1]. While the liquid temperature of the system was controlled to be within a range of 20° C. to 23° C. by cooling the liquid in a water bath so as not to increase the temperature of the system due to shearing heat from a mixer, the system was mixed using a TK Homomixer at 8,000 rpm to 15,000 rpm for 2 minutes, followed by stirring for 10 minutes while controlling the number of revolutions by a three-one motor equipped with an anchor blade to 130 rpm to 350 rpm, to thereby obtain [Particle Slurry 1] in which oil phase-liquid droplets to be particles were dispersed in the aqueous phase.

<Desolvation>

Into a vessel equipped with a stirrer and a thermometer, [Particle Slurry 1] was charged, and the solvent was removed therefrom at 30° C. for 8 hours while stirring, to obtain [Dispersion Slurry 1].

<Washing/Drying>

After [Dispersion Slurry 1] (100 parts) was filtered under reduced pressure, (1): 100 parts of ion exchanged water were added to the resulting filtration cake, and mixed at 12,000 rpm for 10 minutes using a TK homomixer, followed by a filtration treatment.

(2): Into the resulting filtration cake (1), 900 parts of ion exchanged water were added, and mixed by a TK Homomixer at 12,000 rpm for 30 minutes while applying a ultrasonic wave vibration thereto and then filtered under reduced pressure. This operation was repeated so that the electric conductivity of the reslurry liquid was 10 μC/cm or lower.

(3): A 10% hydrochloric acid was added to the reslurry liquid (2) so that pH of the reslurry liquid (2) was 4, and stirred with a three-one motor for 30 minutes, followed by a filtration treatment.

(4): Into the filtration cake (3), 100 parts of ion exchanged water were added, mixed at 12,000 rpm for 10 minutes using a TK homomixer, followed by a filtration treatment. This operation was repeated so that the electric conductivity of the reslurry liquid was 10 μC/cm or lower to thereby obtain [Filtration Cake 1].

[Filtration Cake 1] was dried by a circular air drier at 32° C. for 48 hours, and sieved with a mesh with openings of 75 μm to thereby obtain [Toner Base 1] (volume average particle diameter (Dv): 6.2 μm; Dv/Dn: 1.13).

Next, 0.5 parts of a hydrophobic silica and 0.5 parts of a hydrophobized titanium oxide were added to 100 parts of [Toner Base 1] and mixed by a HENSCHEL MIXER to thereby obtain Toner 1 of the present invention.

Example 2

Toner 2 was obtained in the same manner as in Example 1, except that [Resin Dispersion Liquid 1] was changed to [Resin Dispersion Liquid 2].

Example 3

Toner 3 was obtained in the same manner as in Example 1, except that [Resin Dispersion Liquid 1] was changed to [Resin Dispersion Liquid 4].

Example 4

Toner 4 was obtained in the same manner as in Example 1, except that [Resin Dispersion Liquid 1] was changed to [Resin Dispersion Liquid 5].

Example 5

Toner 5 was obtained in the same manner as in Example 1, except that [Resin Dispersion Liquid 1] was changed to [Resin Dispersion Liquid 6].

Example 6

Toner 6 was obtained in the same manner as in Example 1, except that [Resin Dispersion Liquid 1] was changed to [Resin Dispersion Liquid 7].

Example 7

[Pigment-Wax Dispersion Liquid 1] (976 parts), and isophorone diamine (2.4 parts) were mixed in a TK Homomixer (manufactured by PRIMIX Corporation) at 5,000 rpm for 1 minute. Subsequently, [Resin Dispersion Liquid 10] (596 parts) was added to the mixture and mixed at 8,000 rpm for 1 minute, and [Isocyanate-Modified Polyester 1] (88 parts) was added thereto, followed by mixing by a TK Homomixer (manufactured by PRIMIX Corporation) at 5,000 rpm for 1 minute, to thereby obtain [Oil Phase 2].

<Production of Particles>

[Aqueous Phase 1] (1,100 parts) was added to the resulting [Oil Phase 2]. While the liquid temperature of the system was controlled to be within a range of 20° C. to 23° C. by cooling the liquid in a water bath so as not to increase the temperature of the system due to shearing heat from a mixer, the system was mixed using a TK Homomixer at 8,000 rpm to 15,000 rpm for 2 minutes, followed by stirring for 7 minutes while controlling the number of revolutions by a three-one motor equipped with an anchor blade to 130 rpm to 350 rpm, to thereby obtain [Particle Slurry 2] in which oil phase-liquid droplets to be particles were dispersed in the aqueous phase.

<Desolvation>

Into a vessel equipped with a stirrer and a thermometer, [Particle Slurry 2] was charged, and the solvent was removed therefrom at 30° C. for 8 hours while stirring, to obtain [Dispersion Slurry 2].

<Washing/Drying>

After [Dispersion Slurry 2] (100 parts) was filtered under reduced pressure, (1): 100 parts of ion exchanged water were added to the resulting filtration cake, and mixed at 12,000 rpm for 10 minutes using a TK homomixer, followed by a filtration treatment.

(2): Into the resulting filtration cake (1), 900 parts of ion exchanged water were added, and mixed by a TK Homomixer at 12,000 rpm for 30 minutes while applying a ultrasonic wave vibration thereto and then filtered under reduced pressure. This operation was repeated so that the electric conductivity of the reslurry liquid was 10 μC/cm or lower.

(3): A 10% hydrochloric acid was added to the reslurry liquid (2) so that pH of the reslurry liquid (2) was 4, and stirred with a three-one motor for 30 minutes, followed by a filtration treatment.

(4): Into the filtration cake (3), 100 parts of ion exchanged water were added, mixed at 12,000 rpm for 10 minutes using a TK homomixer, followed by a filtration treatment. This operation was repeated so that the electric conductivity of the reslurry liquid was 10 μC/cm or lower to thereby obtain [Filtration Cake 2].

[Filtration Cake 2] was dried by a circular air drier at 32° C. for 48 hours, and sieved with a mesh with openings of 75 μm to thereby obtain [Toner Base 7] (volume average particle diameter (Dv): 6.8 μm; Dv/Dn: 1.17).

Next, 0.5 parts of a hydrophobic silica and 0.5 parts of a hydrophobized titanium oxide were added to 100 parts of [Toner Base 7] and mixed by a HENSCHEL MIXER to thereby obtain Toner 7 of the present invention.

Comparative Example 1

<Preparation of Aqueous Phase>

Ion exchanged water (970 parts), 40 parts of a 25% by mass aqueous dispersion liquid containing organic resin fine particles for dispersion stabilization (a copolymer of ethylene oxide adduct of styrene-methacrylic acid-butyl acrylate-methacrylic acid-sodium sulfate), 95 parts of a 48.5% aqueous solution of dodecyldiphenylether disulfonate, and 98 parts of ethyl acetate were mixed and stirred. The resulting mixture was found to have a pH of 6.2. A 10% by mass sodium hydroxide aqueous solution was added dropwise thereto so that the pH was 12.5, thereby obtaining [Aqueous Phase 2].

<Preparation of Pigment/Wax Dispersion Liquid (Oil Phase)>

Into a vessel equipped with a stirrer and a thermometer, [Polyester 1] (490 parts), [Paraffin Wax (melting point: 74° C.)] (136 parts), [Crystalline Polyester 1] (136 parts), and ethyl acetate (1300 parts) were charged. The temperature of the system was increased to 80° C. while stirring, maintained at 80° C. for 5 hours, and then the system was cooled to 30° C. in 1 hour. Next, [Masterbatch 1] (360 parts) and ethyl acetate (100 parts) were charged into the vessel and mixed for 1 hour to thereby obtain [Material Solution 2].

[Material Solution 2] (1,500 parts) was transferred to a vessel, and passed three times through a bead mill, ULTRA VISCOMILL (manufactured by Aimex Co., Ltd.) under the following conditions: liquid feed rate: 1 kg/hr, disc circumferential speed: 6 m/sec, 0.5 mm-zirconia bead filled at 80% by volume, so that the pigment and the wax were dissolved. Next, 385 parts of a 72% by mass ethyl acetate solution of [Polyester 1] was added to the resulting solution, and passed through the beads mill once under the same conditions to thereby obtain [Pigment/Wax Dispersion Liquid 2]. Then, ethyl acetate was added to [Pigment/Wax Dispersion Liquid 2] so that the solid content concentration thereof (at 130° C. for 30 minutes) was 50% by mass.

<Production of Particles>

[Pigment-Wax Dispersion Liquid 2] (985 parts) and isophoronediamine (2.6 parts) were mixed using a TK Homomixer (manufactured by PRIMIX Corporation) at 5,000 rpm for 1 minute, [Isocyanate-Modified Polyester 1] (80 parts) was further added thereto, and mixed using the TK Homomixer (manufactured by PRIMIX Corporation) at 5,000 rpm for 1 minutes. Subsequently, [Aqueous Phase 2] (1,200 parts) was added thereto and mixed for 2 minutes using the TK Homomixer while controlling the number of revolutions to 8,000 rpm to 15,000 rpm to thereby obtain [Particle Slurry 3].

<Desolvation>

Into a vessel equipped with a stirrer and a thermometer, [Particle Slurry 3] was charged, and the solvent was removed therefrom at 30° C. for 8 hours while stirring, to obtain [Dispersion Slurry 3].

<Washing/Drying>

After [Dispersion Slurry 3] (100 parts) was filtered under reduced pressure, (1): 100 parts of ion exchanged water were added to the resulting filtration cake, and mixed at 12,000 rpm for 10 minutes using a TK homomixer, followed by a filtration treatment.

(2): Into the resulting filtration cake (1), 900 parts of ion exchanged water were added, and mixed by a TK Homomixer at 12,000 rpm for 30 minutes while applying a ultrasonic wave vibration thereto and then filtered under reduced pressure. This operation was repeated so that the electric conductivity of the reslurry liquid was 10 μC/cm or lower.

(3): A 10% hydrochloric acid was added to the reslurry liquid (2) so that pH of the reslurry liquid (2) was 4, and stirred with a three-one motor for 30 minutes, followed by a filtration treatment.

(4): Into the filtration cake (3), 100 parts of ion exchanged water were added, mixed at 12,000 rpm for 10 minutes using a TK homomixer, followed by a filtration treatment. This operation was repeated so that the electric conductivity of the reslurry liquid was 10 μC/cm or lower to thereby obtain [Filtration Cake 3].

[Filtration Cake 3] was dried by a circular air drier at 32° C. for 48 hours, and sieved with a mesh with openings of 75 μm to thereby obtain [Toner Base 101] (volume average particle diameter (Dv): 6.2 μm; Dv/Dn: 1.13).

Next, 0.5 parts of a hydrophobic silica and 0.5 parts of a hydrophobized titanium oxide were added to 100 parts of [Toner Base 101] and mixed by a HENSCHEL MIXER to thereby obtain Toner 101.

Comparative Example 2

Toner 102 was obtained in the same manner as in Example 1, except that [Resin Dispersion Liquid 1] was changed to [Resin Dispersion Liquid 3].

Comparative Example 3

Toner 103 was obtained in the same manner as in Comparative Example 1, except that [Crystalline Polyester 1] was changed to ethylene glycol distearate.

Comparative Example 4

Toner 104 was obtained in the same manner as in Example 1, except that [Resin Dispersion Liquid 1] was changed to [Resin Dispersion Liquid 8].

Comparative Example 5

Resin Dispersion Liquid 1 35 parts by mass
Resin Dispersion Liquid 9 55 parts by mass
Releasing Agent Dispersion Liquid 10 parts by mass
Cyan Pigment Dispersion Liquid 12 parts by mass
aluminum polychloride 0.16 parts by mass
ion exchanged water 550 parts by mass The components described above were sufficiently mixed and dispersed in a round-type stainless-steel flask by a homogenizer (ULTRA TALAX T50 manufactured by IKA Co.), and the system was heated to 48° C. while stirring in a heating oil bath to make particles aggregate. Upon confirmation that the particle diameter of the particles was 5.6 μm, the pH of the system was controlled with a 0.5 moL/L sodium hydroxide aqueous solution to 6.0, and the system was heated to 94° C. while continuously stirring. During increasing the temperature of the system to 94° C., the pH of the system decreased to approximately 5.0, however, the pH was maintained as it was. When the degree of circularity of particles became 0.970, the system was cooled, filtered and sufficiently washed with ion exchanged water, followed by solid-liquid isolation through Nutche aspiration filtration. Then, the resulting product was re-dispersed in 3 litters of ion exchanged water at 40° C., stirred for 15 minutes and washed. This washing operation was repeated 5 times, and subjected to solid-liquid isolation through Nutche aspiration filtration, followed by vacuum drying for 12 hours to thereby obtain Toner Base 105. Toner Base 105 was found to have a volume average particle diameter of 6.1 μm, Dv/Dn of 1.16, and a degree of circularity of 0.969. Next, 0.5 parts of a hydrophobic silica and 0.5 parts of a hydrophobized titanium oxide were added to 100 parts of [Toner Base 105] and mixed by a HENSCHEL MIXER to thereby obtain Toner 105.

[Evaluation Method]

The toners produced as above were evaluated according to the following method. Note that a copier, IPSIO SP C220 manufactured by Ricoh Company Ltd. was remodeled by removing a fixing unit therefrom, so that an image before fixing was taken out.

Meanwhile, the fixing unit that had been removed from the copier was remodeled so that the temperature of the fixing roller and the system speed were optionally changed externally.

1. Heat Resistant Storage Stability (1)

A toner sample (20 g) was put in a 20 mL glass bottle, and left standing for 24 hours in a thermostatic bath heated at 55° C. Thereafter, the toner sample was cooled to 24° C., and then measured for its penetration by a penetration test (JIS K2235-1991). The greater the value of penetration rate, the more excellent in heat resistant storage stability of the toner is. When the penetration rate value was smaller than 10 mm, there is a high probability that a practical problem occurs.

The evaluation criteria for heat resistant storage stability based on the penetration rate were as follows:

A: 20 mm or greater
B: 15 mm or greater but smaller than 20 mm
C: 10 mm or greater but smaller than 15 mm
D: Smaller than 10 mm 2. Heat Resistant Storage Stability (2)

A toner sample (20 g) was put in a 20 mL glass bottle, and a load of 1 kg was applied thereonto, and left standing for 24 hours in a thermostatic bath heated at 55° C. Thereafter, the toner sample was cooled to 24° C., and then measured for its penetration rate by a penetration test (JIS K2235-1991). The greater the value of penetration rate, the more excellent in heat resistant storage stability of the toner is. When the penetration rate value was smaller than 10 mm, there is a high probability that a practical problem occurs.

The evaluation criteria for heat resistant storage stability based on the penetration rate were as follows:

A: 20 mm or greater

B: 15 mm or greater but smaller than 20 mm

C: 10 mm or greater but smaller than 15 mm

D: Smaller than 10 mm

3. Fixability (Minimum Fixing Temperature) (1)

The toner was placed in the remodeled PISIO SP C220, and the copier was set so that the amount of the toner added onto paper, 6200 Y-Type paper, produced by Ricoh Company Ltd. was 8 g/m$^2$, and 19 sheets of 40 mm square unfixed solid print image were prepared.

Next, using the remodeled fixing unit, the system speed was set to 350 mm/sec, the unfixed solid image prepared as above was passed to fix the image on paper. The fixing test was performed while varying the fixing temperature from 120° C. to 200° C. in increments of 5° C. An image tester AD-401 manufactured by Ueshima Seisakusho K.K. was made travel on colored portions of the fixed image (B) in a contact state under the conditions: a sapphire needle: 125 μR, a needle rotation diameter: 8 mm, and a load: 1 g. The surface of tip portion of the sapphire needle which was made travel on the fixing image was visually observed, and a temperature at which scratches were obviously recognized as white spots was regarded as NG. A minimum temperature at which the evaluation result was not NG was regarded as a minimum fixing temperature.

A: The minimum fixing temperature was 130° C. or lower.

B: The minimum fixing temperature was 135° C. to 140° C.

C: The minimum fixing was 145° C. to 150° C.

D: The minimum fixing temperature was 155° C. or higher.

4. Fixability (Minimum Fixing Temperature) (2)

The toner was placed in the remodeled PISIO SP C220, and the copier was set so that the amount of the toner added onto paper, 6200 Y-Type paper, produced by Ricoh Company Ltd. was 8 g/m$^2$, and 19 sheets of 40 mm square unfixed solid print image were prepared.

Next, using the remodeled fixing unit, the system speed was set to 800 mm/sec, the unfixed solid image prepared as above was passed to fix the image on paper. The fixing test was performed while varying the fixing temperature from 120° C. to 200° C. in increments of 5° C. An image tester AD-401 manufactured by Ueshima Seisakusho K.K. was made travel on colored portions of the fixed image (B) in a contact state under the conditions: a sapphire needle: 125 μR, a needle rotation diameter: 8 mm, and a load: 1 g. The surface of tip portion of the sapphire needle which was made travel on the fixing image was visually observed, and a temperature at which scratches were obviously recognized as white spots was regarded as NG. A minimum temperature at which the evaluation result was not NG was regarded as a minimum fixing temperature.

A: The minimum fixing temperature was 140° C. or lower.

B: The minimum fixing temperature was 145° C. to 150° C.

C: The minimum fixing was 155° C. to 160° C.

D: The minimum fixing temperature was 165° C. or higher.

5. Resistant to Developing Stress

Each of the toners was put in a process cartridge of IPSIO CX2500 manufactured by Ricoh Company Ltd., and a surface of a developing roller on which the toner was conveyed when the developing roller was rotated at 350 rpm for 60 minutes at a temperature of 28° C. and a relative humidity of 45% was observed.

When streaky nonuniformity is present, apparent abnormal portions are not observed in a solid image, but image nonuniformity corresponding to streaky nonuniformity appears in a halftone image. In addition, when there are streaky portions where toner is not provided, image defects occurs not only in a halftone image but alto in solid image portions, which also cause a problem with outputting of typical documents including only characters.

A: An image was uniformly formed on the developing roller on which the toner was conveyed B: A small amount of streaky nonuniformity in a toner conveyance direction was observed on the developing roller on which the toner was conveyed C: Streaky nonuniformity in a toner conveyance direction was apparently observed on the developing roller on which the toner was conveyed, but there was no portion where toner was not provided.

D: Streaky nonuniformity in a toner conveyance direction was apparently observed on the developing roller on which the toner was conveyed, and there were some portions where toner was not provided.

The results were shown in Table 1.

TABLE 1

| | Binder resin (R) | | Crystalline material (A) | | | | Evaluation result: Storage stability | | Low temperature fixability | | Resistance to |
|---|---|---|---|---|---|---|---|---|---|---|---|
| | | Tg | | Melting point | Capsule | (I) | (Heating) | (Heating/ Pressurizing) | (Low speed) | (High speed) | developing stress |
| Ex. 1 | Polyester 1 | 67 | Crystalline Polyester 1 | 43 | Provided | Styrene acrylic resin | A | B | A | B | A |
| Ex. 2 | Polyester 1 | 67 | Crystalline Polyester 2 | 68 | Provided | Styrene acrylic resin | A | A | B | B | A |
| Ex. 3 | Polyester 1 | 67 | Methyl stearate | 39 | Provided | Styrene acrylic resin | B | C | A | A | C |
| Ex. 4 | Polyester 1 | 67 | Lauric acid | 44 | Provided | Styrene acrylic resin | B | B | A | A | B |
| Ex. 5 | Polyester 1 | 67 | Myristic acid | 55 | Provided | Styrene acrylic resin | A | B | A | A | B |

TABLE 1-continued

| | Binder resin (R) | Tg | Crystalline material (A) | Melting point | Capsule | (I) | Evaluation result: Storage stability (Heating) | Storage stability (Heating/Pressurizing) | Low temperature fixability (Low speed) | Low temperature fixability (High speed) | Resistance to developing stress |
|---|---|---|---|---|---|---|---|---|---|---|---|
| Ex. 6 | Polyester 1 | 67 | Ethylene glycol distearate | 63 | Provided | Styrene acrylic resin | A | B | B | B | B |
| Ex. 7 | Polyester 1 | 67 | N-[2-(diethylamino)ethyl] stearamide | 54 | Provided | Styrene acrylic resin | A | B | A | A | C |
| Comp. Ex. 1 | Polyester 1 | 67 | Crystalline Polyester 1 | 43 | None | Not used | D | D | B | B | D |
| Comp. Ex. 2 | Polyester 1 | 67 | Crystalline Polyester 3 | 113 | Provided | Styrene acrylic resin | A | A | D | D | A |
| Comp. Ex. 3 | Polyester 1 | 67 | Ethylene glycol distearate | 63 | None | Not used | D | D | B | B | D |
| Comp. Ex. 4 | Polyester 1 | 67 | Pentaerithritol tetrabehenate | 83 | Provided | Styrene acrylic resin | A | B | D | D | A |
| Comp. Ex. 5 | Styrene acrylic resin | 59 | Crystalline Polyester 1 | 43 | Provided | Styrene acrylic resin | D | D | C | C | D |

What is claimed is:

1. A toner comprising:

an amorphous resin (R), a crystalline material (A) which is compatible with the amorphous resin (R) and has a melting point of 80° C. or lower, a resin (I) which is different from the amorphous resin (R), and a colorant, wherein the crystalline material (A) is capsulated by the resin (I) and the capsulated crystalline material (A) is present in the amorphous resin (R).

2. The toner according to claim 1, wherein the amorphous resin (R) is an amorphous polyester resin.

3. The toner according to claim 1, wherein the crystalline material (A) has a melting point lower than 60° C.

4. The toner according to claim 1, wherein the crystalline material (A) has a melting point lower than 50° C.

5. The toner according to claim 1, wherein the crystalline material (A) is a crystalline polyester.

6. The toner according to claim 1, wherein the crystalline material (A) is a straight-chain hydrocarbon carboxylic acid having 8 to 20 carbon atoms.

7. The toner according to claim 1, wherein the crystalline material (A) is one of a straight-chain hydrocarbon ester containing an alkyl chain having carbon atoms of 12 or more and a straight-chain hydrocarbon amide containing an alkyl chain having carbon atoms of 12 or more.

8. The toner according to claim 1, wherein the crystalline material (A) is a straight-chain hydrocarbon ester having total carbon atoms of 8 to 20 per divalent linking group containing ester.

9. A toner production method for producing the toner as claimed in claim 1, comprising:

forming a capsule by capsulating a crystalline material (A) by a resin (I), where the capsule contains at least the crystalline material (A) and the resin (I), and dispersing the capsule in an amorphous resin (R), wherein the crystalline material (A) is compatible with the amorphous resin (R) and has a melting point of 80° C. or lower.

10. The toner production method according to claim 9, further comprising:

mixing a first dispersion liquid in which the capsule is dispersed in an aqueous medium, a second dispersion liquid in which the amorphous resin (R) is dispersed in an aqueous medium, and a third dispersion liquid containing colorant particles, adding an aggregation agent to the dispersion liquid so that aggregated particles are formed by the capsule, the amorphous resin (R) and the colorant particles, and allowing the aggregated particles to coalesce by increasing the temperature thereof

11. The toner production method according to claim 9, further comprising:

dissolving or dispersing, in an organic solvent, at least the capsule, the amorphous resin (R), and the colorant to prepare an oil phase, preparing an aqueous phase containing at least a surfactant in the aqueous medium, dispersing the oil phase in the aqueous phase to prepare a dispersion liquid in which particles formed of the oil phase are dispersed, removing the organic solvent from the dispersion liquid, washing the particles, and drying the particles to removed water therefrom.

12. The toner production method according to claim 9, wherein the amorphous resin (R) is an amorphous polyester resin.

13. The toner production method according to claim 9, wherein the crystalline material (A) has a melting point lower than 60° C.

14. The toner production method according to claim 9, wherein the crystalline material (A) has a melting point lower than 50° C.

15. The toner production method according to claim 9, wherein the crystalline material (A) is a crystalline polyester.

16. The toner production method according to claim 9, wherein the crystalline material (A) is a straight-chain hydrocarbon carboxylic acid having 8 to 20 carbon atoms.

17. The toner production method according to claim 9, wherein the crystalline material (A) is one of a straight-chain hydrocarbon ester containing an alkyl chain having carbon atoms of 12 or more and a straight-chain hydrocarbon amide containing an alkyl chain having carbon atoms of 12 or more.

18. The toner production method according to claim 9, wherein the crystalline material (A) is a straight-chain hydrocarbon ester having total carbon atoms of 8 to 20 per divalent linking group containing ester.

19. A process cartridge comprising:

a photoconductor, and at least a device configured to develop a latent image on the photoconductor with a developer, as an integral unit, wherein the process cartridge is detachably mounted on an image forming apparatus, wherein the developer comprises the toner as claimed in claim 1.

* * * * *